US011377984B2

(12) United States Patent
Klampfer et al.

(10) Patent No.: US 11,377,984 B2
(45) Date of Patent: Jul. 5, 2022

(54) COUPLING DEVICE FOR A VALVE-ACTUATING DEVICE

(71) Applicant: AVL LIST GMBH, Graz (AT)

(72) Inventors: Martin Klampfer, Hitzendorf (AT); Andreas Zurk, Weinburg (AT); Thomas Salmutter, Graz (AT); Jürgen Gelter, Graz (AT)

(73) Assignee: AVL List GmbH, Graz (AT)

( * ) Notice: Subject to any disclaimer, the term of this patent is extended or adjusted under 35 U.S.C. 154(b) by 167 days.

(21) Appl. No.: 16/635,830

(22) PCT Filed: Aug. 1, 2018

(86) PCT No.: PCT/EP2018/070916
§ 371 (c)(1),
(2) Date: Jun. 2, 2020

(87) PCT Pub. No.: WO2019/025511
PCT Pub. Date: Feb. 7, 2019

(65) Prior Publication Data

US 2020/0300131 A1 Sep. 24, 2020

(30) Foreign Application Priority Data

Aug. 1, 2017 (AT) ..... A 50643/2017

(51) Int. Cl.
*F01L 13/00* (2006.01)
*F01L 1/18* (2006.01)

(52) U.S. Cl.
CPC ..... *F01L 13/0005* (2013.01); *F01L 1/181* (2013.01); *F01L 13/0036* (2013.01);
(Continued)

(58) Field of Classification Search
CPC . F01L 13/0005; F01L 13/0036; F01L 13/065; F01L 13/0015; F01L 13/0031;
(Continued)

(56) References Cited

U.S. PATENT DOCUMENTS 4,901,685 A * 2/1990 Fukuo ..... F01L 1/267 123/90.16
6,273,039 B1 8/2001 Church
(Continued)

FOREIGN PATENT DOCUMENTS

DE 102007033757 1/2009
FR 2969707 6/2012
(Continued)

OTHER PUBLICATIONS

English Translation of International Search Report for International (PCT) Patent Application No. PCT/EP2018/070916, dated Oct. 15, 2018, 2 pages.

*Primary Examiner* — Zelalem Eshete
(74) *Attorney, Agent, or Firm* — Sheridan Ross P.C.

(57) ABSTRACT

The present invention relates to a coupling device for a valve-actuating device for actuating at least one valve of a reciprocating machine having variable valve lift, in particular for a valve-actuating device of a reciprocating internal combustion engine, to a valve-actuating device and to a reciprocating machine, the coupling device comprising a first coupling element, a second coupling element and a blocking means. The first coupling element and the second coupling element can be displaced relative to one another at least within defined boundaries along a first axis, it being possible for the blocking means to block the relative displacement of the two coupling elements with respect to one another along the first axis at least in a first direction. The blocking means comprises a blocking element, which can be rotated about the first axis in the circumferential direction at
(Continued)

Figure 1A:
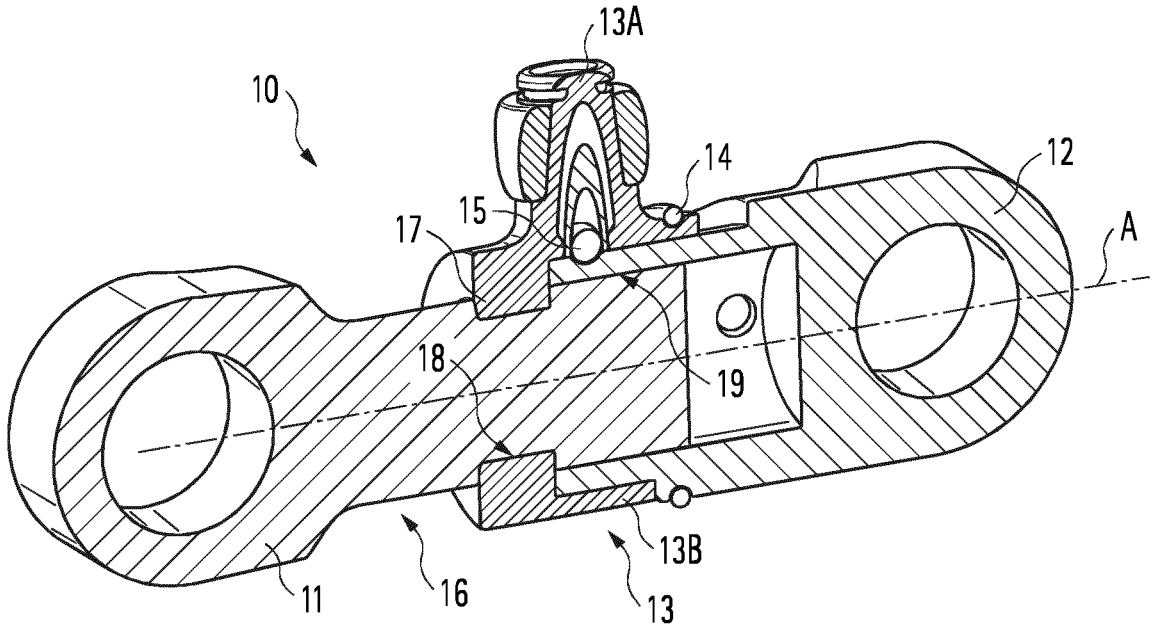

least in a defined region, the relative displacement of the two coupling elements along the first axis being blocked at least in the first direction if the blocking element is in a blocking position.

27 Claims, 10 Drawing Sheets

(52) U.S. Cl.
CPC ... *F01L 2001/186* (2013.01); *F01L 2013/105* (2013.01); *F01L 2305/00* (2020.05)

(58) Field of Classification Search
CPC . F01L 1/181; F01L 1/267; F01L 1/146; F01L 1/36; F01L 1/08; F01L 2305/00; F01L 2001/186; F01L 2001/054; F01L 2013/105; F01L 2013/101; F01L 2013/106; F02D 17/02
See application file for complete search history.

(56) References Cited

U.S. PATENT DOCUMENTS

| | | | |
|---|---|---|---|
| 2008/0264370 | A1 | 10/2008 | Shewell |
| 2010/0186691 | A1 | 7/2010 | Werler |
| 2014/0326212 | A1 | 11/2014 | Baltrucki et al. |

FOREIGN PATENT DOCUMENTS

| | | |
|---|---|---|
| WO | WO 2008/012679 | 1/2008 |
| WO | WO 2015/022071 | 2/2015 |

* cited by examiner

COUPLING DEVICE FOR A VALVE-ACTUATING DEVICE

CROSS REFERENCE TO RELATED APPLICATIONS

This application is a national stage application under 35 U.S.C. 371 and claims the benefit of PCT Application No. PCT/EP2018/070916 having an international filing date of 1 Aug. 2018, which designated the United States, which PCT application claimed the benefit of Austria Patent Application No. A50643/2017 filed 1 Aug. 2017, the disclosures of each of which are incorporated herein by reference in their entireties.

The present invention relates to a coupling apparatus for a valve-actuating apparatus for actuating at least one valve of a reciprocating machine with variable valve lift, in particular for a valve-actuating apparatus of a reciprocating internal combustion engine. The present invention further relates to an above-mentioned valve-actuating apparatus as well as a reciprocating machine having such a valve-actuating apparatus.

Generic coupling apparatus and valve-actuating apparatus as well as reciprocating machines, in particular reciprocating machines having such valve-actuating apparatus, are known in general in the prior art.

Due to increasing demands with respect to performance, efficiency and emissions, variable valve trains; i.e. valve trains with variable valve lift, are becoming increasingly important in reciprocating internal combustion engines, particularly in reciprocating internal combustion engines in four-stroke operation and in six-stroke operation.

Variable valve trains can thereby meet the need of internal combustion engine design engineers and the thermodynamic aspirations relative to conveying alternatingly different valve lift curves to one or more valves, particularly depending on the operating condition of the internal combustion engine, whereby both the valve lift as well as the opening and closing points can be adapted.

This is generally achieved by changing the valve train's transmission path. Various applications make series use of lift-switching and lift-cutout systems with switchable cam followers such as bucket tappets, roller tappets or rocker arms. The rule being that for each additional alternative valve lift, there also needs to be a corresponding cam as an element to provide lift—unless the alternative lift is zero lift.

There are diverse areas of application for using valve trains with varying or variable valve lift. A few examples are listed below:

Lift switching: Lift switching enables the use of at least two different operating point-dependent valve lifts. A lesser valve lift specifically matched to the partial load range is thereby used, which improves the torque curve and reduces consumption and emissions. Large valve lift can be optimized to further increase performance. A lesser valve lift with lower maximum lift and of shorter length enables the gas exchange work (Miller cycle) to be reduced due to a significantly earlier intake closing point and the dethrottling in the intake section. Similar results are possible with the Atkinson cycle; i.e. extremely late intake closure. Optimal filling of the combustion chamber thereby results in an increase in torque in the partial load range.

Cylinder cutoff: Cylinder cutoff is predominantly used with large volume, multi-cylinder engines (for example with four, eight, ten or twelve cylinders). In the process, selected engine cylinders are shut down by cutting the lift on the intake and exhaust valves; complete decoupling from the cam lift thereby ensues. Equidistant sequential firing enables switching common V8 and V12 engines to A4 or R6 engines respectively. The purpose of engine cylinder cutoff is to minimize the gas exchange losses and shift the operating point to higher mean effective pressures and thus higher thermodynamic efficiencies, whereby considerable fuel savings can be achieved.

Engine braking operation: Engine brake systems enabling engine braking operation are becoming increasingly more important in vehicle internal combustion engines, particularly for commercial vehicles, since they are cost-effective and space-saving auxiliary brake systems able to relieve the wheel brakes, particularly on longer downhill driving. In addition, the increase in the specific performance of modern commercial vehicle engines also entails an increase in the braking power to be achieved.

In order to produce an engine braking effect, it is known to provide additional macro valves in the engine cylinders of an internal combustion engine via which so-called decompression braking can be effected by the additional engine valves decompressing the cylinder at the end of the compression stroke, particularly in the case of a four-stroke or six-stroke engine. This results in exhausting the work on the compressed gas via the internal combustion engine's exhaust system. Furthermore, the internal combustion engine must in turn work to refill the cylinder with gas again. Known among other things is generating an engine braking effect by way of a variable valve train of the actual exhaust valves.

Various systems and concepts are known for modifying valve lift. Known in particular is providing a coupling apparatus between one or more cam lift-transmitting valve-actuating elements of a valve-actuating apparatus, by means of which the transmission path of the valve train can be changed.

For example, US 2014/0326212 A1 shows a system for variable valve control, in particular for generating an engine braking effect, which comprises a "lost motion" device having hydraulically actuatable blocking elements in order to selectively block and unblock a valve-actuating mechanism such that valve-actuating motions are selectively transmitted or not transmitted to one or more valves in order to change the valve lift and thereby produce in particular an engine braking effect.

WO 2015/022071 discloses a valve-actuating device for actuating at least a first valve of a reciprocating piston machine, in particular an internal combustion engine, which can be used in particular for engine braking and which comprises a first rocker arm part, a second rocker arm part, and a first switching element for changing the valve lift of the at least one first valve, wherein the first rocker arm part and the second rocker arm part are pivot-mounted and arranged such that at least a first valve control motion of a first camshaft can be transmitted to the at least one first valve via the first rocker arm part and the second rocker arm part.

One task of the invention is providing an improved coupling apparatus, in particular a particularly simple coupling apparatus, for a valve-actuating apparatus. A further task of the invention is providing an improved valve-actuating apparatus, in particular one which is mechanically actuatable with the aid of a cam, as well as an improved reciprocating machine having such a valve-actuating apparatus.

The invention solves this task by means of a coupling apparatus according to claim 1, a valve-actuating apparatus according to claim 21, and a reciprocating machine according to claim 28. Advantageous embodiments of the invention constitute the subject matter of the subclaims and are explained in greater detail below. The teaching of the claims is expressly made a part of the description.

A first aspect of the present invention relates to a coupling apparatus for a valve-actuating apparatus for actuating at least one valve of a reciprocating machine with variable valve lift, in particular for a valve-actuating apparatus of a reciprocating internal combustion engine, wherein the coupling apparatus comprises at least a first coupling element, a second coupling element and a blocking device with a blocking element. The first coupling element and the second coupling element and/or the first coupling element and the blocking element are displaceable relative to one another along a first axis and the blocking device can block the relative displacement of the two coupling elements to one another and/or the relative displacement between the first coupling element and the blocking element at least in a first direction along the first axis.

The two coupling elements and/or the first coupling element and the blocking element are thereby displaceable along the first axis relative to one another, in particular at least within defined limits, whereby the defined limits are determined in particular by the structural design of the coupling apparatus and/or its surroundings, particularly by the kinematic and/or spatial circumstances.

According to the invention, the blocking element can be circumferentially rotated about the first axis at least over a defined angular range, wherein when the blocking element is in a blocking position, the relative displacement of the two coupling elements to one another along the first axis and/or the relative displacement between the first coupling element and the blocking element is blocked at least in the first direction.

Such a coupling apparatus enables simple mechanical valve actuation at least at one defined valve lift, in particular when functionally used in an appropriately configured valve-actuating apparatus, whereby a first defined valve lift can be set in which the blocking element is brought into the blocking position.

A coupling apparatus within the meaning of the invention is a device for coupling, in particular the mechanical and/or kinematic coupling, of at least two elements, in particular at least two actuating elements.

A coupling element within the meaning of the invention is an element designed for the mechanical and/or kinematic coupling.

A valve-actuating apparatus within the meaning of the invention is an apparatus for actuating one or more valves of a reciprocating machine, in particular a reciprocating internal combustion engine.

A valve within the meaning of the invention is an intake or exhaust valve, in particular an intake or an exhaust valve of a reciprocating internal combustion engine.

A variable valve lift within the meaning of the invention is a valve lift able to be varied in any given way. In particular, there can be two variable valve lift states; i.e. firstly zero lift and, secondly, a defined valve lift.

A blocking device within the meaning of the invention is a device able to block in particular an axial relative displacement between two defined elements. A blocking element within the meaning of the invention is a component of a blocking device.

A valve-actuating motion within the meaning of the invention is a kinematic event generated in particular by a cam on a camshaft and transmitted to a valve. The event is characterized in particular by the physical variables of position, speed and acceleration.

The solution according to the invention is in particular based on the approach of configuring the coupling apparatus such that a valve-actuating motion is either transmitted or not transmitted to an associated valve to be actuated so that a first defined valve lift or a second defined valve lift, in particular a zero lift, can be set, in particular selectively.

Therefore, according to the invention, there is no need for hydraulic, electronic or electromagnetic devices for transmitting valve lift from a camshaft to a valve. According to the invention, in particular a rotational motion generated by a cam can be used to set the valve lift.

In some particular applications, it can be advantageous for the coupling apparatus to be designed in the manner of a telescopic rod, whereby in this case preferably the first axis of the coupling apparatus coincides with the longitudinal axis of the coupling apparatus.

In order to reduce the friction and/or to set a defined friction in the coupling apparatus, the parts which slide against each other can exhibit a friction-reducing surface and/or a surface of defined roughness and/or be coated and/or lubricated with a lubricant.

In one advantageous embodiment of a coupling apparatus according to the invention, the coupling apparatus is designed such that the relative displacement of the two coupling elements to one another and/or the relative displacement between the first coupling element and the blocking element along the first axis is unblocked at least in the first direction when the blocking element is in an unblocking position, whereby preferably the blocking element is rotatable about the first axis at least between one unblocking position and one blocking position.

A coupling apparatus designed as such enables simple mechanical valve actuation at least at two differently defined valve lifts, particularly when functionally used in an appropriately configured valve-actuating apparatus, whereby a first defined valve lift can be set by means of the coupling apparatus when the blocking element is in the blocking position and a second defined valve lift, in particular zero lift, when the blocking element is in the unblocking position. In particular, a coupling apparatus according to the invention enables valve lift control which is variable within certain limits.

Thereby having proven advantageous in the case of some particular applications is for the blocking element to be circumferentially rotatable about the first axis over a defined angular range extending from approximately 15 degrees to approximately 30 degrees in the circumferential direction. In other particular applications, other defined angular ranges may be more advantageous, for example up to 45 degrees or 60 degrees or even up to 90 degrees or less than 15 degrees.

In particular, the coupling apparatus is designed such that a defined relative displacement of the two coupling elements with respect to each other along the longitudinal axis of the coupling apparatus is blocked in a first state of the coupling apparatus and the relative displacement is unblocked in a second state of the coupling apparatus, whereby the relative displacement can preferably be selectively unblocked or blocked.

The coupling apparatus is thereby preferably designed such that a kinematic coupling of a first actuating element mechanically coupled to the first coupling element to a second actuating element mechanically coupled to the second coupling element of the coupling device can be effected by blocking the relative displacement and by unblocking the relative displacement of the kinematic separation between the two actuating elements.

In a further advantageous embodiment of a coupling apparatus according to the invention, the coupling apparatus is designed to be arranged in a valve-actuating apparatus, in particular arranged in a valve-actuating apparatus able to be actuated by means of a rotatable cam, whereby the valve-actuating apparatus is designed to actuate at least one valve of a reciprocating machine with variable valve lift and comprises at least a first valve-actuating element and in particular a second valve-actuating element, wherein the coupling apparatus is preferably designed such that the first coupling element can be mechanically coupled, in particular connected, to the first valve-actuating element and the second coupling element to the second valve-actuating element or a valve to be actuated.

The coupling apparatus is thereby in particular designed such that for transmitting a valve-actuating motion from a first valve-actuating element of the valve-actuating device to a second valve-actuating element of the valve-actuating device, a kinematic coupling of the first valve-actuating element and the second valve-actuating element is effectible and/or separable by means of the coupling apparatus, in particular selectively.

The coupling device is preferably designed such that when the coupling apparatus is functionally used in a valve-actuating device, given a corresponding design of the valve-actuating apparatus and corresponding mechanical coupling of the first coupling element and a first valve-actuating element of a valve-actuating device, a valve-actuating motion introduced into the coupling apparatus by the first valve-actuating element of the valve-actuating device and the first coupling element in consequence of a valve-actuating motion in the blocked state of the coupling apparatus can be transmitted along the first axis to the second coupling element and from there, given a corresponding mechanical coupling of the second coupling element and a second valve-actuating element of the valve-actuating device, further along to the second valve-actuating element so that a defined valve lift can be effected, and/or such that a valve-actuating motion introduced into the coupling apparatus along the first axis by the first coupling element in the unblocked state of the coupling apparatus leads to an axial displacement of the first coupling element relative to the second coupling element but not to transmission of the valve-actuating motion to the second coupling element such that there is no or less resulting axial displacement of the second coupling element and in particular a second defined valve lift, preferably a zero lift, can be set.

A coupling device designed in this manner thus allows the enabling or preventing of transmission of a defined valve-actuating motion and a controlling of the valve lift of a valve of a reciprocating machine, in particular a reciprocating internal combustion engine, mechanically coupled to the coupling apparatus.

In a further advantageous embodiment of an inventive coupling apparatus, the blocking element exhibits an annular or sleeve-like section, whereby preferably the annular or sleeve-like section of the blocking element at least partially overlaps the first coupling element and/or the second coupling element in the axial direction.

In particular, the annular or sleeve-like section of the blocking element thereby at least partially extends around the first coupling element and/or the second coupling element, preferably at an angle of circumference of more than 180 degrees, in particular at an angle of circumference of more than 270 degrees, preferably entirely. Preferably, the annular or sleeve-like section of the blocking element extends around the first coupling element and/or the second coupling element from the outside. In other words, the annular or sleeve-like section of the blocking element is realized such that it at least partially extends around the first and/or the second coupling element from the outside preferably at an angle of circumference of more than 180 degrees, in particular at an angle of circumference of more than 270 degrees, preferably entirely.

In particular, at least one of the two coupling elements, particularly the first coupling element, can be pushed along the first axis at least partially into the blocking device, in particular into the blocking element, and/or can be pushed through the blocking device, in particular the blocking element.

Preferably, the blocking device, in particular the blocking element, comprises a first sliding guide element designed to cooperate with a second sliding guide element of a slider block guide corresponding in design to the first sliding guide element, wherein the slider block guide can effect a rotational movement of the blocking device, particularly the blocking element, around the first axis, in particular from the unblocking position into the blocking position and vice versa. This thereby enables simple mechanical actuation of the blocking element and thus a simple mechanical adjustment of the valve lift.

In particular, the first sliding guide element is a link pin extending radially outward, particularly a radially outward extending pin arranged on the annular or sleeve-like section of the blocking device, in particular the blocking element. Particularly simple mechanical actuation of the blocking element can be effected with the aid of a pin.

In this case, the defined angular range in which the blocking element can be rotated about the first axis is preferably dimensioned, in particular not selected as too large, so as to ensure that the first sliding guide element and the second sliding guide element are always sufficiently engaged with one another as to ensure reliable actuation of the blocking device. Response times also increase with increasing angular range.

Preferably, the blocking device, in particular the blocking element, is at least partially, in particular completely, axially fixed along the first axis relative to at least one coupling element, in particular relative to the second coupling element.

The blocking device, in particular the blocking element, can in addition be fixed to the coupling element, for example by means of a retaining ring, and/or axially fixed by means of a pretensioning device and axially braced, for example by means of a spring, in a defined position relative to the coupling element, in particular relative to the second coupling element, at least in the unblocking position.

In a further advantageous embodiment of a coupling apparatus according to the invention, the coupling apparatus comprises a lash adjusting apparatus for setting kinematic play in the coupling apparatus, in particular for setting kinematic play in the axial direction along the first axis. An appropriately designed lash adjusting apparatus enables setting at least one virtually, in particular wholly, no-load state relative to the first axis; i.e. a non-axial load state in the direction of the first axis, when the coupling apparatus is functionally used in an appropriately configured mechanical valve-actuating device, in particular when the valve-actuating device can be actuated by means of a rotatable cam. This thereby enables actuation of the coupling apparatus in a virtually load-free or load-free state. This thereby has the advantage of being able to significantly reduce wear of the coupling device, in particular the blocking device, versus actuation under load.

In a further advantageous embodiment of an inventive coupling apparatus, the first coupling element and the second coupling element can be at least partially telescoped into one another along the first axis, in particular when the blocking element is in the unblocking position.

In particular, one of the two coupling elements, in particular the first coupling element, exhibits a free, piston-like end thereto and the other, in particular second, coupling element exhibits a free, cylinder-like end and faces the free end of the first coupling element, wherein the free piston-like end of the one coupling element can be at least partially pushed into the cylinder-like end of the other coupling element along the first axis, whereby the coupling element with the piston-like end is preferably guided through the coupling element with the cylinder-like end in the course of the relative displacement.

In a further advantageous embodiment of an inventive coupling apparatus, at least one of the two coupling elements and the blocking device, in particular the first coupling element and the blocking device, can be at least partially telescoped into one another along the first axis, in particular when the blocking element is in the unblocking position, wherein preferably the first coupling element can be at least partially pushed into the blocking element along the first axis.

Particularly in this case, one of the two coupling elements, in particular the first coupling element, exhibits a free, piston-like end and the blocking element is preferably of cylindrical design and exhibits an open end facing the free end of the first coupling element and an oppositely disposed closed end, whereby the free, piston-like end of the coupling element, in particular of the first coupling element, can be at least partially pushed into the cylinder-like, open end of the blocking element along the first axis.

Furthermore, the closed end of the blocking element can in this case preferably be supported on the other coupling element, in particular on the second coupling element, particularly by means of a spring element, preferably by means of a preloaded spring element.

In a further advantageous embodiment of an inventive coupling apparatus, one of the coupling elements, in particular the first coupling element, exhibits a first section, in particular a section extending along the first axis and/or the longitudinal direction of the associated coupling element which has external longitudinal toothing, and a second section formed without toothing, whereby the second section preferably, in particular likewise, extends along the first axis and/or the longitudinal direction of the associated coupling element and in particular adjoins the first section.

In particular, an external diameter of the coupling element's second section formed without toothing is thereby smaller than a tip diameter of the external longitudinal toothing of the coupling element's first section, whereby in particular the external diameter of the second section is smaller than or equal to the root diameter of the external longitudinal toothing of the first section.

In a further advantageous embodiment of an inventive coupling apparatus, the blocking element exhibits a section extending in the axial direction which has an internal longitudinal toothing corresponding in form to the external longitudinal toothing of the first section of the coupling element, wherein the internal longitudinal toothing is in particular arranged on an inner surface of the annular and/or sleeve-like section of the blocking element.

In a further advantageous embodiment of an inventive coupling apparatus, the blocking element is in the blocking position when the coupling element with the external longitudinal toothing is axially displaced relative to the blocking element such that the internal longitudinal toothing is not engaged with the external longitudinal toothing of the coupling element but the internal longitudinal toothing of the blocking element is instead at the level of the second section formed without toothing, and when the blocking element is rotated in the circumferential direction such that at least one tooth, in particular all the teeth, of the outer longitudinal toothing of the first section of the coupling element at least partially align axially with at least one tooth, in particular with all the teeth, of the internal longitudinal toothing of the blocking element.

The end faces of the teeth preferably abut against each other as a result. In so doing, the aligned teeth, in particular their end faces, can axially support a compressive force applied to the coupling element, and a valve-actuating motion can be transmitted.

In the embodiment as described above, the defined angular range, about which the blocking element can be circumferentially rotated about the first axis, is preferably dimensioned at least such that the internal longitudinal toothing of the blocking element can be brought into engagement with the external longitudinal toothing of the coupling element so as to unblock the relative displacement, and can be arranged relative to the external longitudinal toothing of the coupling element to block the relative displacement such that at least one tooth, in particular all the teeth, of the external longitudinal toothing of the coupling element's first section at least partially align axially with at least one tooth, in particular with all the teeth, of the internal longitudinal toothing of the blocking element.

In a further advantageous embodiment of an inventive coupling apparatus, the blocking element is in the unblocking position when the blocking element is circumferentially rotated such that all the teeth of the external longitudinal toothing of the coupling element's first section are offset to all the teeth of the internal longitudinal toothing of the blocking element so that the teeth of the outer longitudinal toothing of the first coupling element are engaged with the teeth of the internal longitudinal toothing at least over part of their axial length or can be brought into engagement with each other by an axial relative displacement between the coupling element and the blocking element.

As defined by the invention, "engaged" is thereby understood to mean the interlocking, in particular comb-like aligning of the teeth of an external toothing with the internal toothing, whereby the teeth flanks do not thereby need to touch; i.e. can also be alternatingly disposed with clearance in between.

In a further advantageous embodiment of an inventive coupling apparatus, the blocking element can be rotated about the first axis when the coupling element with the external longitudinal toothing is axially displaced relative to the blocking element such that the internal longitudinal toothing is not engaged with the external longitudinal toothing of the first coupling element but is instead at the level of the second section formed without teeth.

In some cases it can be advantageous, in particular for axial guidance, for the coupling element with the external longitudinal toothing to comprise a further section with external longitudinal toothing, particularly with an identical tooth geometry to the external longitudinal toothing of the first section, wherein the further section preferably adjoins the second section without toothing and is in particular arranged at the free end of the coupling element, particularly such that the second section without toothing is axially arranged between the first section with the external longitudinal toothing and the further section with the external longitudinal toothing.

In a further advantageous embodiment of an inventive coupling apparatus, the blocking device comprises at least one wedge block radially arranged between the inner coupling element and the blocking device, in particular between the inner coupling element and the blocking element, particularly a plurality of wedge blocks in distributed circumferential arrangement, wherein at least one wedge block is axially arranged in an overlap area in which the first coupling element and the second coupling element overlap in the axial direction.

In a further advantageous embodiment of an inventive coupling apparatus, at least one of the wedge blocks, preferably all the wedge blocks, can be inwardly displaced in the radial direction and brought into engagement with the radially inner coupling element, in particular with a recess or a circumferentially extending groove of the radially inner coupling element, so as to block an axial relative displacement between the first coupling element and the second coupling element along the first axis, in particular a telescoping of the two coupling elements into each other.

At least one wedge block is thereby preferably inwardly displaceable in the radial direction against a restoring force, in particular against a return spring.

In particular, at least one of the wedge blocks, preferably all the wedge blocks, is/are inset into a respective recess in the radially outer coupling element, in particular in the second coupling element, whereby at least one of the wedge blocks, preferably all the wedge blocks, is/are axially guided, in particular also circumferentially guided, through the associated recess and/or fixed relative to the radially outer coupling element.

In a further advantageous embodiment of an inventive coupling apparatus, at least one of the wedge blocks, preferably all the wedge blocks, have a circumferentially extending guide surface formed as a ramp, in particular on the radially outer side of the wedge block facing the blocking device, and the blocking device, in particular the blocking element, preferably comprises at least one guide element interacting with the guide surface, same interacting with the guide surface such that particularly a rotating of the blocking element in the circumferential direction from the unblocking position into the blocking position effects a radially inward displacement of the wedge block so that the wedge block is brought into engagement with the radially inner coupling element and an axial relative displacement between the first coupling element and the second coupling element along the first axis is blocked.

Particularly suitable as guide elements are projections and/or rolling bodies, in particular balls, preferably supported in recesses and/or openings in the blocking element, held by the blocking element in the radial direction and on which the wedge blocks roll. Rolling bodies are particularly advantageous for reducing friction.

In a further advantageous embodiment of an inventive coupling apparatus, the blocking device comprises an expansion sleeve radially arranged within the blocking element, wherein the blocking device is in particular designed such that the expansion sleeve can be compressed in the radial direction and/or circumferential direction by rotating the blocking element in a first direction about the first axis, in particular by rotating the blocking element in the direction of the blocking position.

An expansion sleeve within the meaning of the invention is a sleeve which comprises at least one slot extending at least over part of its length in its longitudinal direction and the external diameter of which can be reduced, compared to when in an unloaded state, in particular by applying a tensile force acting in the circumferential direction and/or a radial compressive force. An expansion sleeve in the sense of the invention comprises in particular a continuous slot extending over its entire length or a plurality of slots preferably in uniformly distributed circumferential arrangement which only extends over part of its length. An expansion sleeve in the sense of the invention can be cylindrical or comprise one or more conical sections. In particular, the external diameter can decrease in one direction along its longitudinal axis, in particular continuously, sectionally continuously or discontinuously.

In a further advantageous embodiment of an inventive coupling apparatus, the expansion sleeve can be expanded in the radial direction and/or circumferential direction, in particular compared to the blocking position, by rotating the blocking element in a second direction about the first axis, in particular by rotating the blocking element in the direction of the unblocking position.

In a further advantageous embodiment of an inventive coupling apparatus, at least one coupling element and the expansion sleeve, preferably the coupling element to which the expansion sleeve is not axially fixed, and the expansion sleeve, in particular the first coupling element and the expansion sleeve, are axially displaceable relative to one another along the first axis, in particular can be at least partly pushed into each other telescopically when the expansion sleeve is not compressed in the radial direction and/or circumferential direction. In contrast, an axial relative displacement between the other coupling element and the expansion sleeve along the first axis is blocked when the expansion sleeve is at least partially or completely compressed in the radial direction and/or the circumferential direction; i.e. as is possible within the coupling apparatus.

In a further advantageous embodiment of an inventive coupling apparatus, when the blocking element is in the blocking position, at least part of the expansion sleeve, in particular at its free end facing the coupling element axially displaceable relative to the expansion sleeve, exhibits a smaller internal diameter than an external diameter of the coupling element axially displaceable relative to the expansion sleeve, in particular smaller than an external diameter of a shoulder of the coupling element displaceable relative to the expansion sleeve.

Thereby able to be achieved with respect to blocking the relative displacement is the end face of the expansion sleeve being supported on a shoulder of the coupling element which is displaceable relative to the expansion sleeve.

In a further advantageous embodiment of an inventive coupling apparatus, the expansion sleeve exhibits a section conically tapering in particular along the first axis, in particular a section tapering in the direction of the coupling element displaceable relative to the expansion sleeve, and the blocking element rotatable about the first axis preferably comprises a hollow conical section corresponding to the conical section of the expansion sleeve and with which the tapering section of the expansion sleeve interacts, whereby the expansion sleeve is coupled to the blocking element particularly by means of a threading.

As a result, a relative movement between the blocking element and the expansion sleeve in the axial direction; i.e. in the direction of the first axis, can be effected by rotating the blocking element about the first axis and, consequently, a compressing or expanding of the expansion sleeve depending on the blocking element's direction of rotation.

Preferably, the conical sections are in each case disposed outside the threading. Preferably, the expansion sleeve is furthermore axially fixed to one of the two coupling elements, in particular to the second coupling element.

A coupling apparatus according to the invention can be designed for arrangement in a valve-actuating apparatus which has at least one rocker arm with at least a first rocker arm part as the first valve-actuating element and a second rocker arm part as the second valve-actuating element, wherein the first rocker arm part and the second rocker arm part are both rotatably mounted about a common rotational axis, whereby one coupling element can be mechanically coupled, in particular connected, to the first rocker arm part and the other coupling element to the second rocker arm part.

The coupling apparatus can thereby be designed such that both coupling elements can be fixedly secured or both can be pivotally secured to the rocker arm, wherein at least one rotation axis, preferably both rotation axes, run parallel to the common rotational axis of the two rocker arm parts.

A coupling apparatus according to the invention can be designed for arrangement in a valve-actuating apparatus which has at least one rocker arm, in particular a rigid rocker arm, as the first valve-actuating element and a push rod as the second valve-actuating element, wherein one coupling element can be mechanically coupled, in particular connected, to the push rod and the other coupling element to the rocker arm, whereby in particular the cam-side coupling element can be connected to the push rod and the valve-side coupling element to the rocker arm.

A coupling apparatus according to the invention can be designed for arrangement in a valve-actuating apparatus which has at least one rocker arm, in particular a rigid rocker arm, as the first valve-actuating element, wherein one coupling element can be mechanically coupled, in particular connected, to the rocker arm and the other coupling element to a valve to be actuated, whereby in particular the cam-side coupling element can be connected to the rocker arm and the valve-side coupling element to the valve to be actuated.

A coupling apparatus according to the invention can be designed for arrangement in a valve-actuating apparatus which has at least one divided push rod with a first push rod part as the first valve-actuating element and a second push rod part as the second valve-actuating element, whereby one coupling element can be mechanically coupled, in particular connected, to the first push rod part and the other coupling element to the second push rod part.

A coupling apparatus according to the invention can be designed for arrangement in a valve-actuating apparatus which has at least one rocker arm, in particular a rigid rocker arm, as the first valve-actuating element and a valve bridge as the second valve-actuating element, whereby one coupling element can be mechanically coupled, in particular connected, to the rocker arm and the other coupling element to the valve bridge.

A second aspect of the present invention relates to a valve-actuating apparatus, in particular a valve-actuating apparatus able to be actuated by means of a rotatable cam, wherein the valve-actuating apparatus is designed to actuate at least one valve of a reciprocating machine with variable valve lift and comprises a coupling apparatus according to the invention.

In one advantageous embodiment of an inventive valve-actuating apparatus, the valve-actuating apparatus comprises at least one rocker arm having at least one first rocker arm part as the first valve-actuating element and a second rocker arm part as the second valve-actuating element, wherein the first rocker arm part and the second rocker arm part are both rotatably mounted about a common rotational axis, whereby one coupling element is mechanically coupled, in particular connected, to the first rocker arm part and the other coupling element to the second rocker arm part.

Preferably the first coupling element of the coupling apparatus is thereby connected to the cam-side rocker arm part and the second coupling element to the valve-side coupling element. Alternatively, however, the second coupling element can also be connected to the cam-side rocker arm part and the first coupling element to the valve-side coupling element.

Both coupling elements can be fixedly secured or both can be pivotally secured to the rocker arm, whereby at least one rotation axis, preferably both rotation axes, run parallel to the common rotational axis of the two rocker arm parts.

A rocker arm part in the sense of the invention is a section of a valve lifter which serves in transmitting a valve control motion from a camshaft to a valve of a reciprocating piston engine, in particular an internal combustion engine.

In a further advantageous embodiment of an inventive valve-actuating apparatus, the valve-actuating apparatus comprises at least one rocker arm, in particular a rigid rocker arm, as the first valve-actuating element and a push rod as the second valve-actuating element, wherein one coupling element can be mechanically coupled, in particular connected, to the push rod and the other coupling element to the rocker arm, whereby in particular the cam-side coupling element is connected to the push rod and the valve-side coupling element to the rocker arm.

In a further advantageous embodiment, the valve-actuating apparatus comprises at least one rocker arm, in particular a rigid rocker arm, as the first valve-actuating element, wherein one coupling element can be mechanically coupled, in particular connected, to the rocker arm and the other coupling element to a valve to be actuated, whereby in particular the cam-side coupling element can be connected to the rocker arm and the valve-side coupling element to the valve to be actuated.

In a further advantageous embodiment of an inventive valve-actuating apparatus, the valve-actuating apparatus comprises at least one divided push rod having a first push rod part as the first valve-actuating element and a second push rod part as the second valve-actuating element, whereby one coupling element can be mechanically coupled, in particular connected, to the first push rod part and the other coupling element to the second push rod part.

In a further advantageous embodiment of an inventive valve-actuating apparatus, the valve-actuating apparatus comprises at least one rocker arm, in particular a rigid rocker arm, as the first valve-actuating element and a valve bridge as the second valve-actuating element, whereby one coupling element can be mechanically coupled, in particular connected, to the rocker arm and the other coupling element to the valve bridge.

In particular, a valve-actuating device according to the invention is designed such that the blocking device can be actuated in a load-free state, wherein the valve-actuating device in a further advantageous embodiment in particular comprises a lash adjusting apparatus for setting at least one load-free state. This preferably being designed such that at least one load-free state can be set in particular when a cam associated with the valve-actuating apparatus rolls on the base circle.

In a further advantageous embodiment of an inventive valve-actuating apparatus, the valve-actuating apparatus comprises a slider block guide for actuating the blocking device of the coupling apparatus, whereby the slider block guide can effect a rotational movement of the blocking device, particularly the blocking element, around the first axis, in particular from the unblocking position into the blocking position and/or vice versa, wherein a first sliding guide element designed to cooperate with a second sliding guide element of the slider block guide corresponding in design to the first sliding guide element and in particular axially displaceable and supported on the housing side is arranged preferably on the blocking element.

A third aspect of the present invention relates to a reciprocating machine, in particular a reciprocating internal combustion engine, comprising a valve-actuating apparatus according to the invention.

These and other features and advantages follow from the claims and the description as well as from the drawings, whereby an embodiment of the invention can realize the individual features individually or in groupings in the form of subcombinations and can constitute an advantageous as well as protectable implementation, provided same is technically feasible. Some of the cited features or properties respectively relate both to an inventive coupling apparatus as well as an inventive valve-actuating apparatus or also an inventive reciprocating machine. While some of these features and properties are only described once, they apply independently of one another within the scope of technically possible embodiments both for an inventive coupling apparatus as well as for an inventive valve-actuating apparatus or also an inventive reciprocating machine.

The invention will be explained in greater detail below on the basis of non-limiting exemplary embodiments as depicted at least partially schematically in the figures. Components having the same function are thereby provided with the same reference numerals.

Figure 1B:
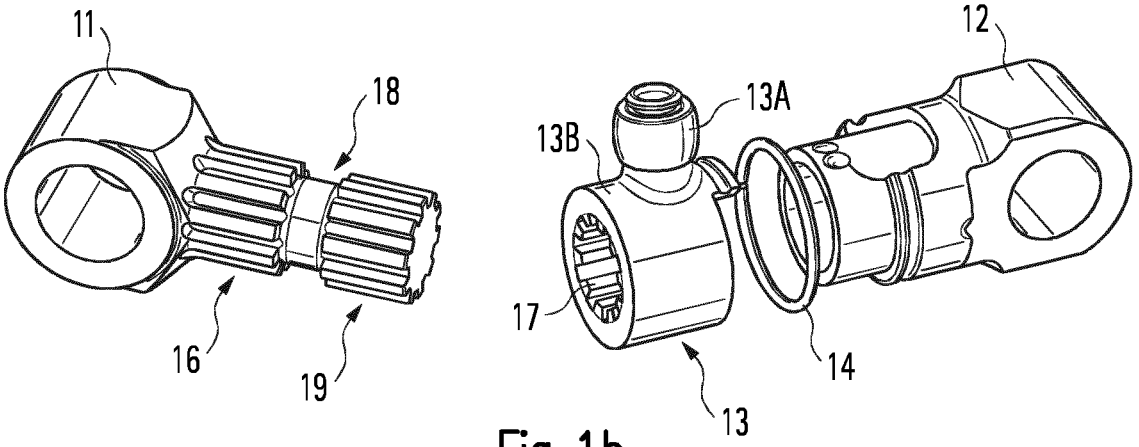
Figure 2:
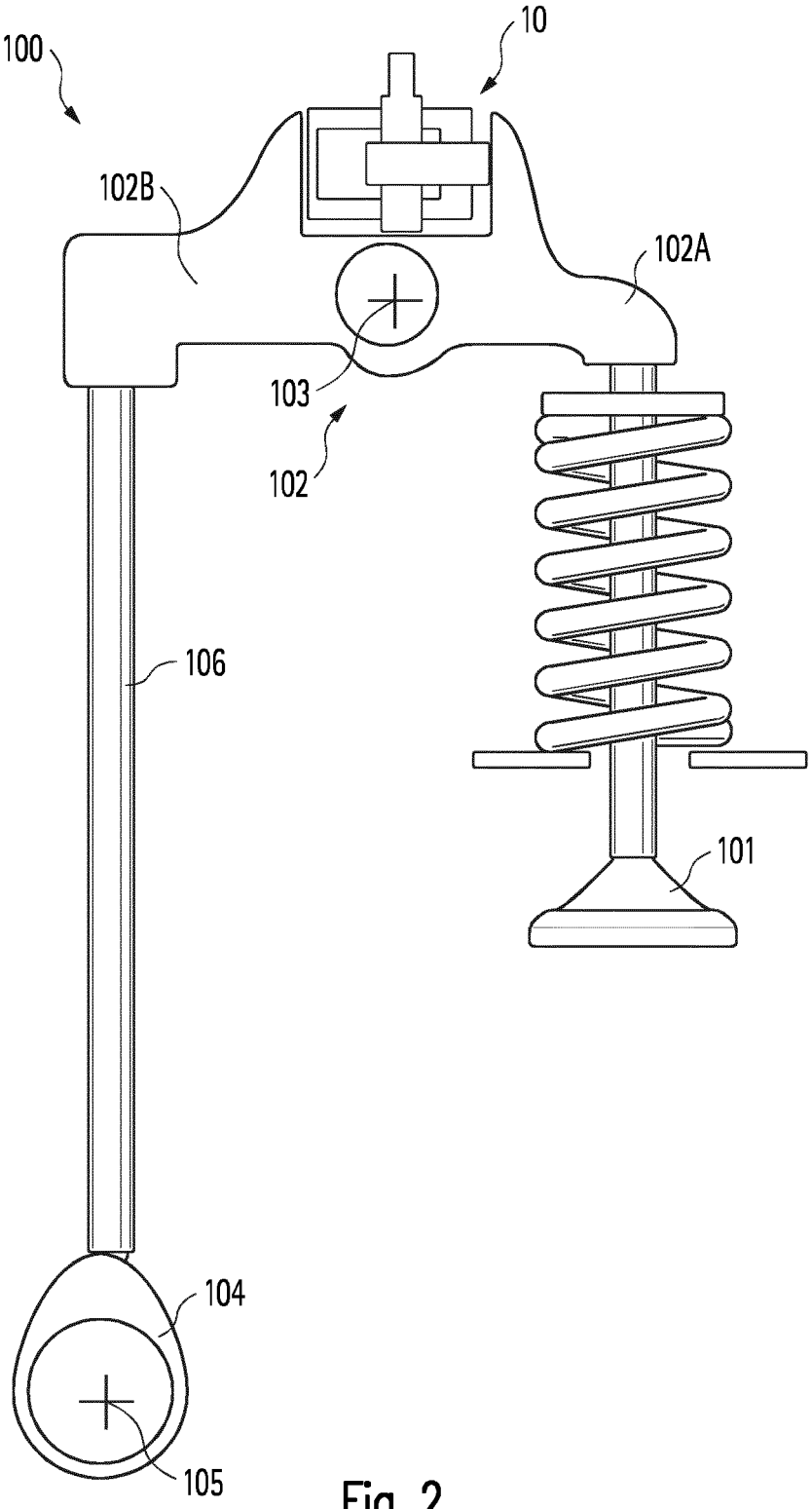
Figure 3:
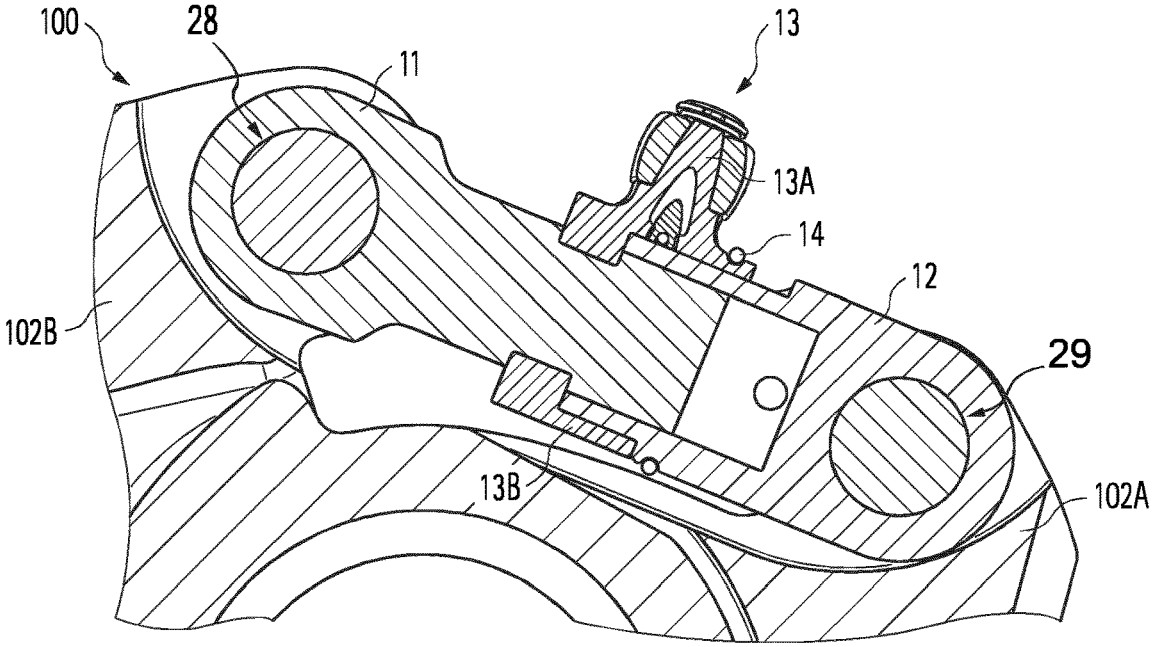
Figure 5:
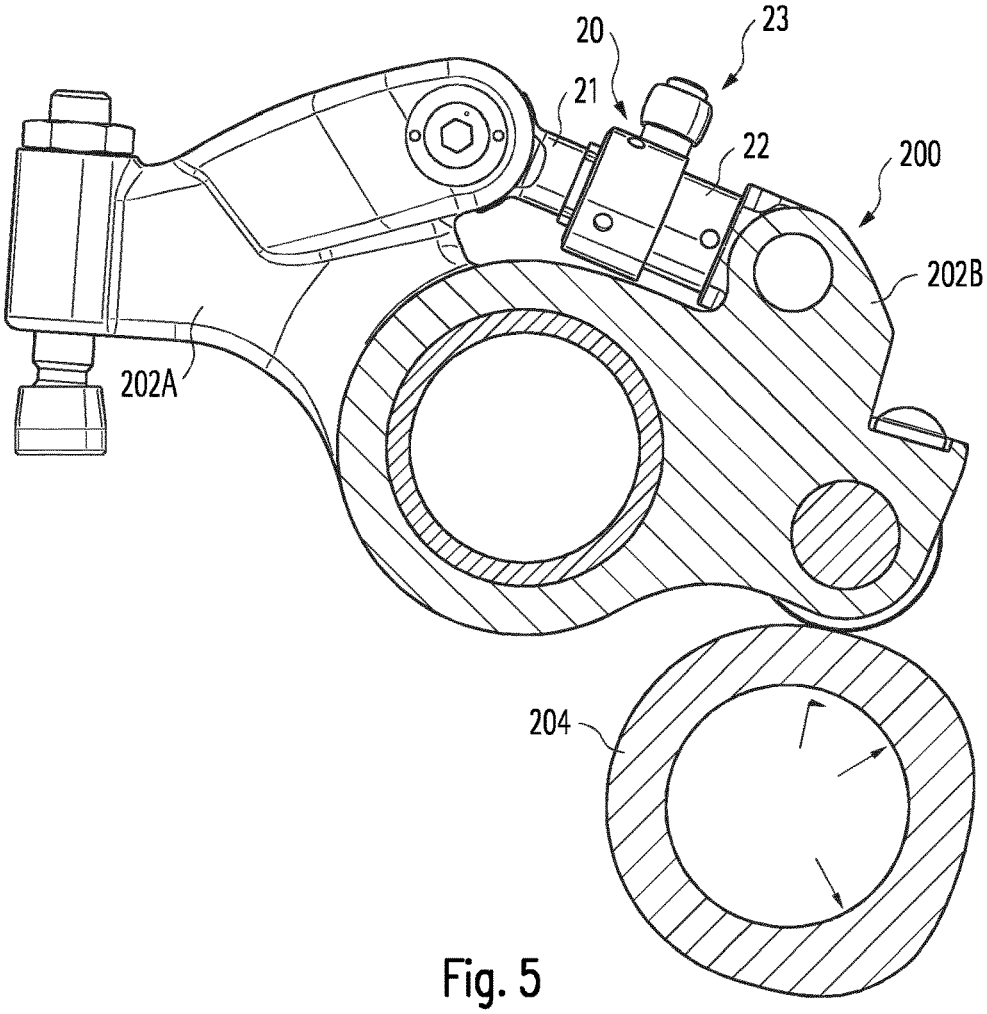
Figure 4A:
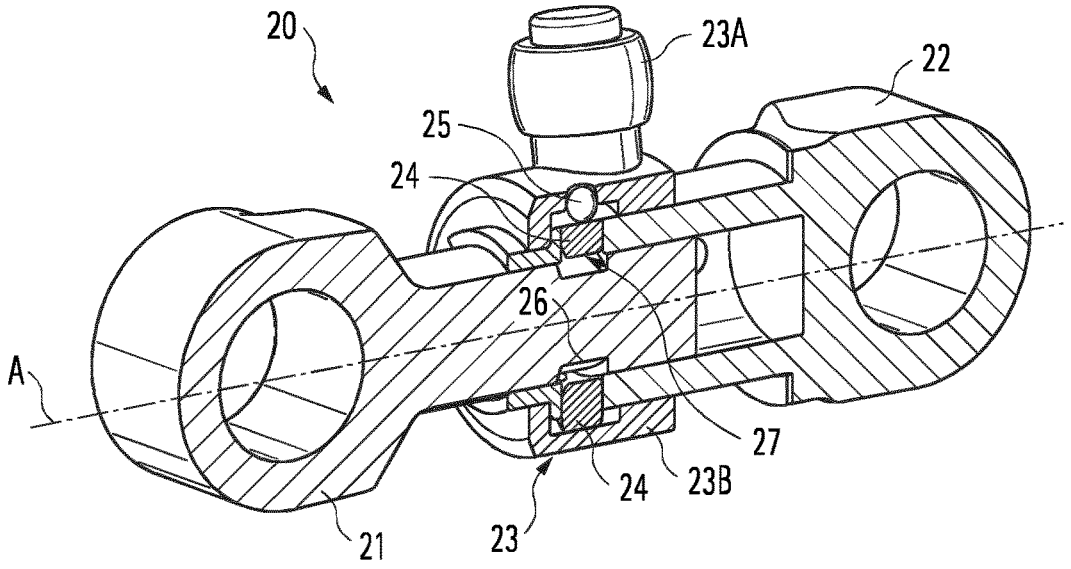
Figure 4B:
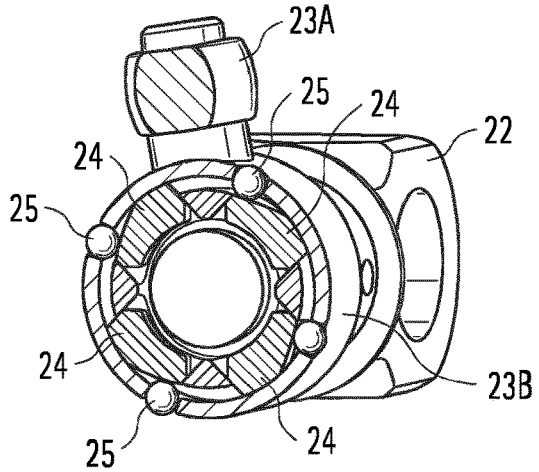
Figure 4C:
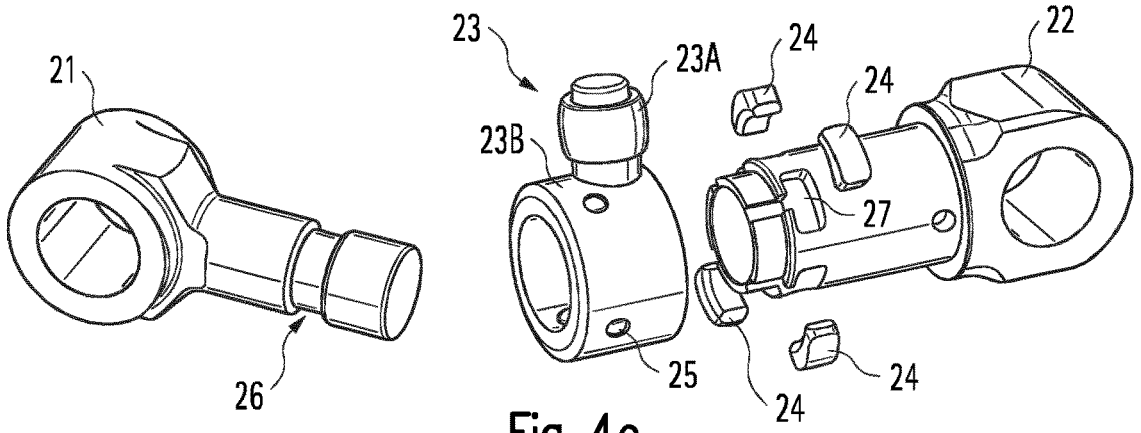
Figure 6A:
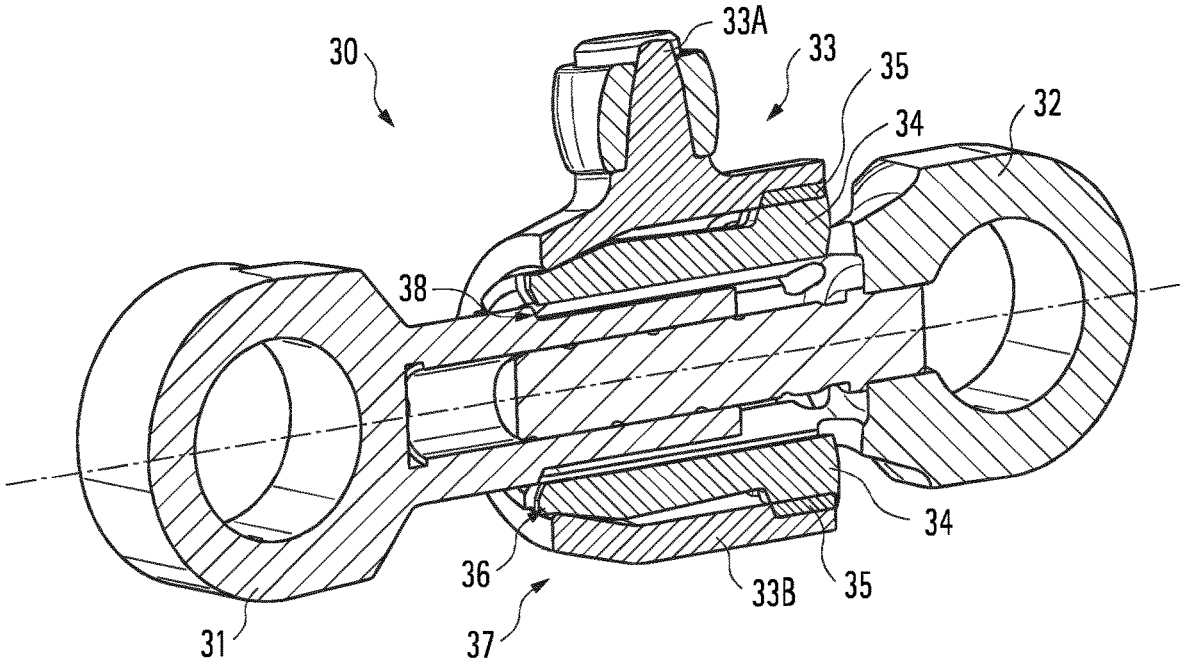
Figure 6B:
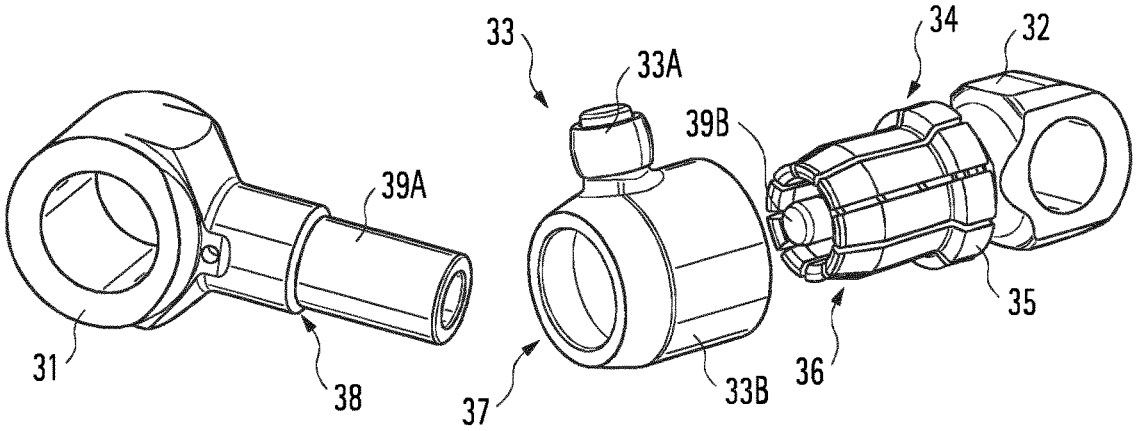
Figure 7A:
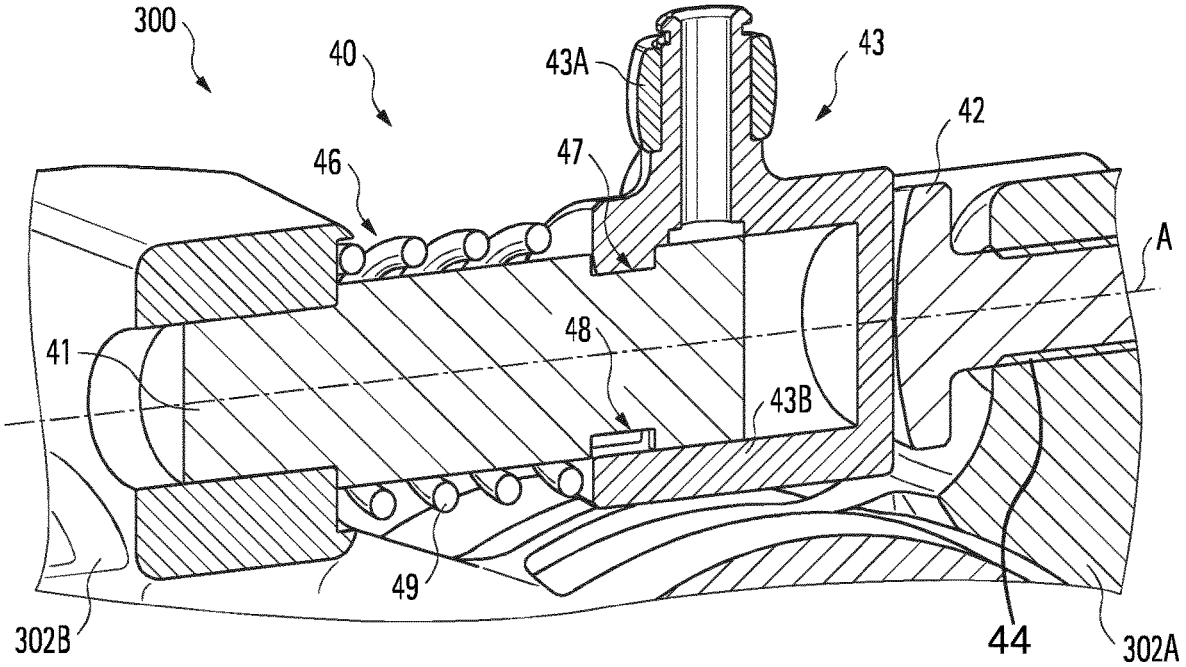
Figure 7B:
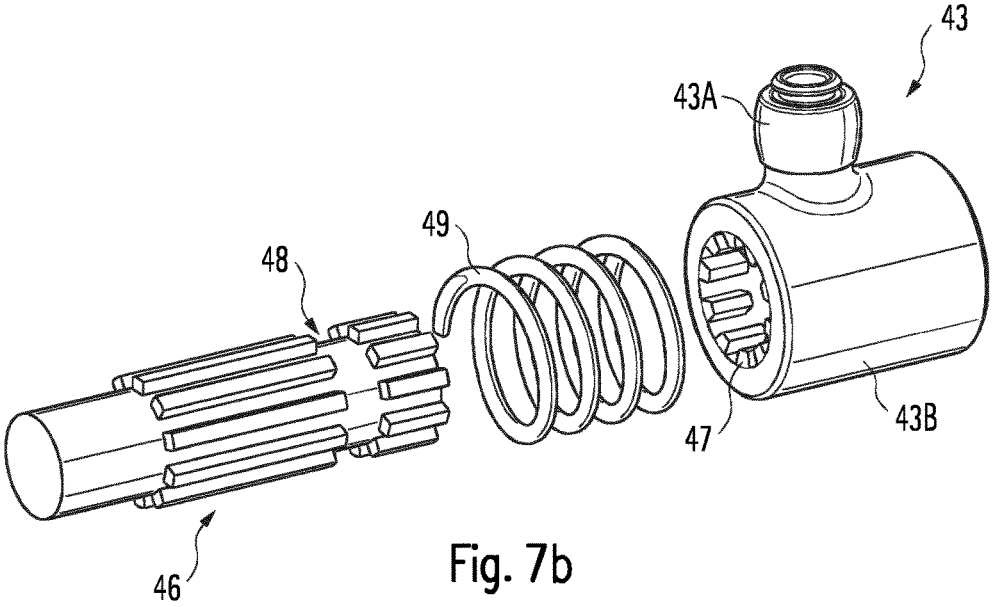
Figure 7C:
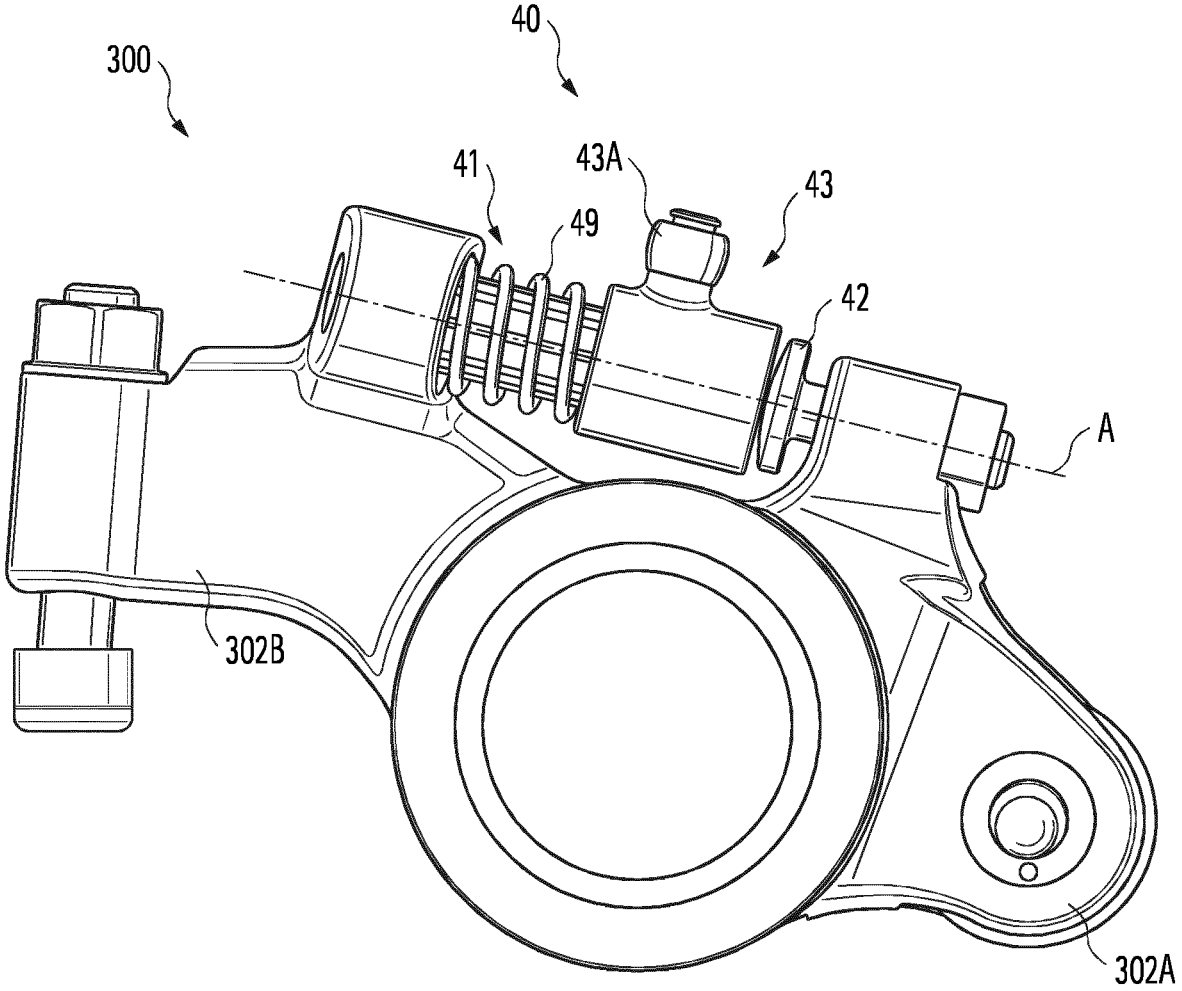
Figure 8:
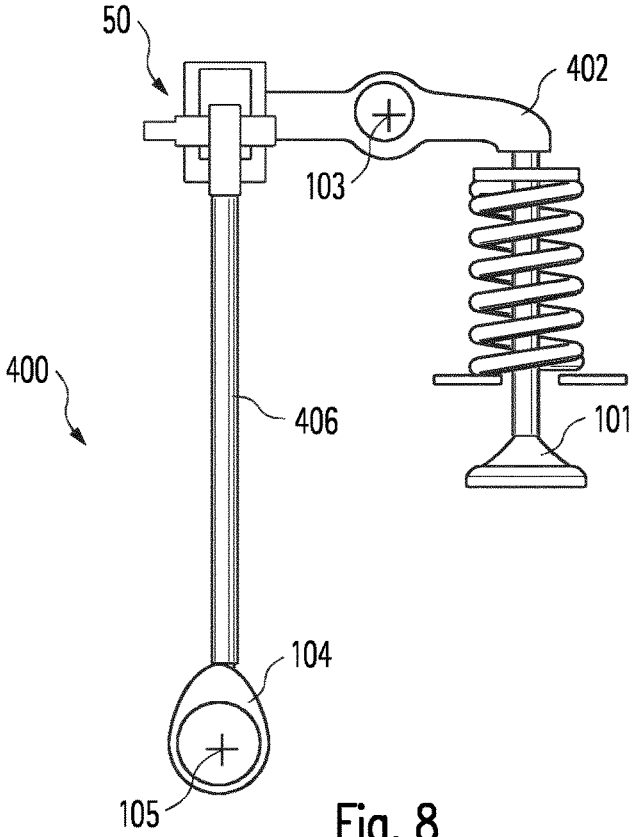
Figure 9:
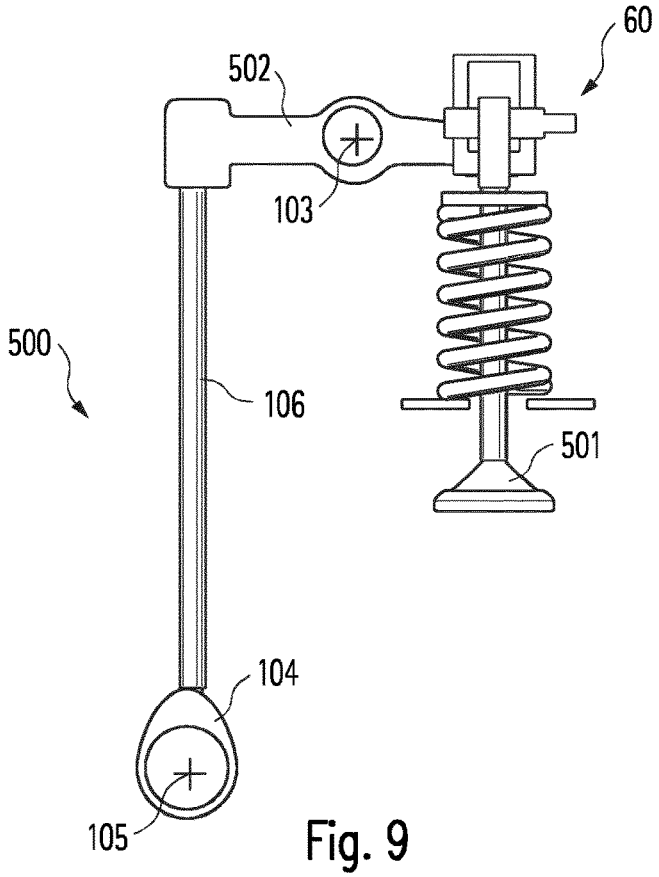
Figure 10:
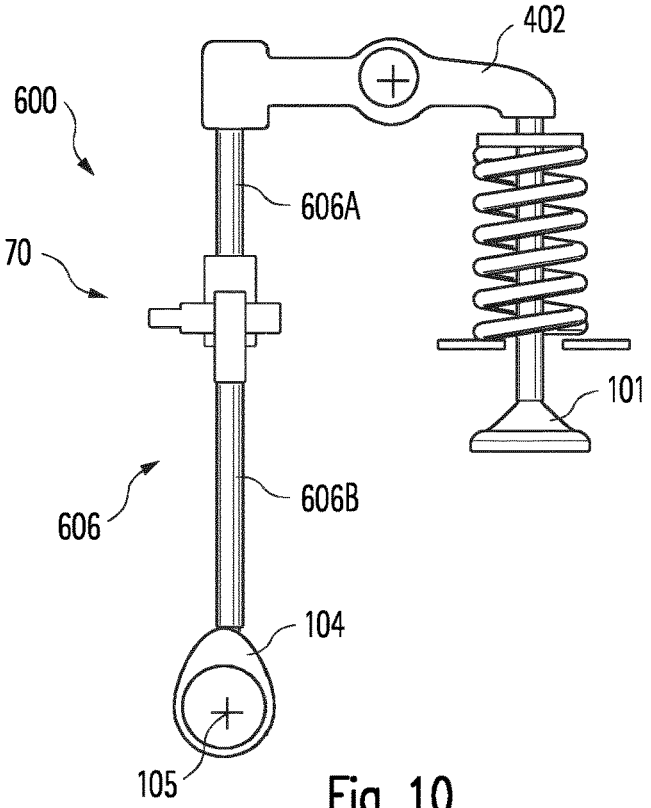
Figure 11:
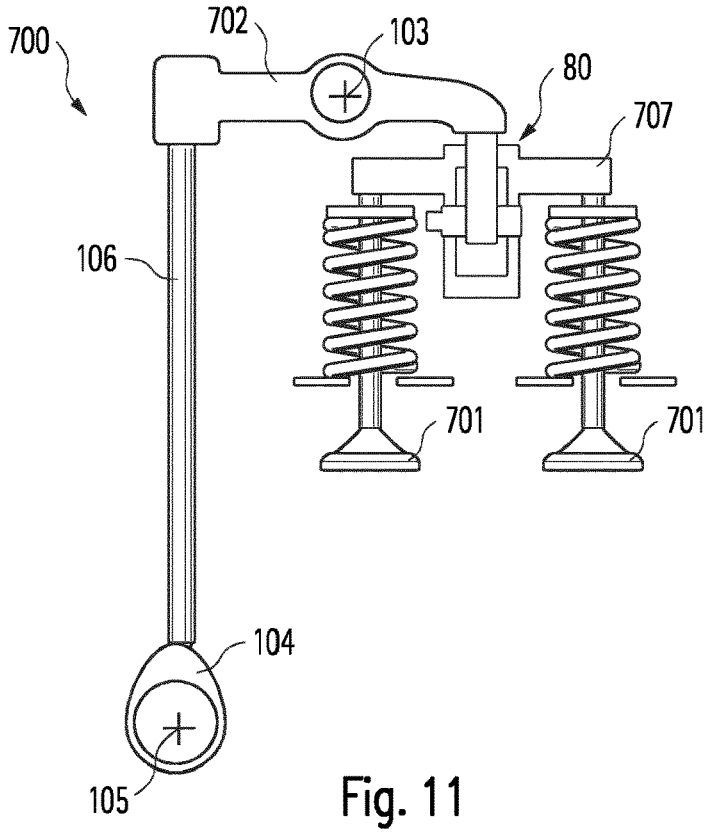
Figure 12:
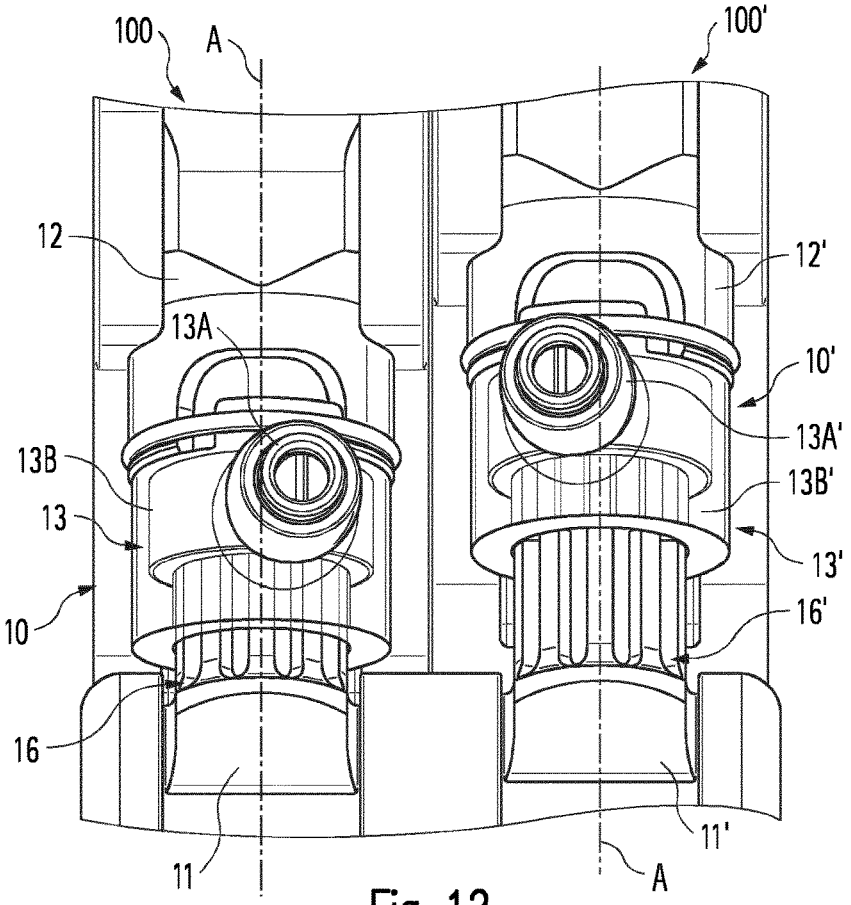

Shown at least partially schematically:

FIG. 1*a* a first exemplary embodiment of a coupling apparatus according to the invention in longitudinal section, FIG. 1*b* the coupling apparatus from FIG. 1*a* in an exploded view, FIG. 2 a schematic depiction of a first exemplary embodiment of an inventive valve-actuating apparatus comprising the coupling apparatus from FIGS. 1*a* and 1*b*, FIG. 3 a cross-sectional detail of the valve-actuating apparatus from FIG. 2 in the area of the inventive coupling apparatus, FIG. 4*a* a second exemplary embodiment of an inventive coupling apparatus in a longitudinal section, FIG. 4*b* a perspective cross-sectional depiction of the coupling apparatus from FIG. 4*a* in the area of the blocking element, FIG. 4*c* the coupling apparatus from FIGS. 4*a* and 4*b* in an exploded view, FIG. 5 a detail of a second exemplary embodiment of an inventive valve-actuating apparatus comprising the coupling apparatus from FIGS. 4*a* to 4*c* in side view, FIG. 6*a* a third exemplary embodiment of an inventive coupling apparatus in longitudinal section, FIG. 6*b* the coupling apparatus from FIG. 6*a* in an exploded view, FIG. 7*a* a detail of a third exemplary embodiment of an inventive valve-actuating device in a longitudinal section through a fourth exemplary embodiment of an inventive coupling apparatus in the area of the coupling apparatus, FIG. 7*b* individual components of the coupling apparatus from FIG. 7*a* in an exploded view, FIG. 7*c* a detail of the valve-actuating apparatus from FIG. 7*a* in side view, FIG. 8 a schematic depiction of a fourth exemplary embodiment of an inventive valve-actuating apparatus comprising a fifth exemplary embodiment of an inventive coupling apparatus, FIG. 9 a schematic depiction of a fifth exemplary embodiment of an inventive valve-actuating apparatus comprising a sixth exemplary embodiment of an inventive coupling apparatus, FIG. 10 a schematic depiction of a sixth exemplary embodiment of an inventive valve-actuating apparatus comprising a seventh exemplary embodiment of an inventive coupling apparatus, FIG. 11 a schematic depiction of a seventh exemplary embodiment of an inventive valve-actuating apparatus comprising an eighth exemplary embodiment of an inventive coupling apparatus, FIG. 12 a detail of a reciprocating internal combustion engine according to the invention comprising two inventive valve-actuating apparatus, each having an inventive coupling apparatus designed as per FIGS. 1*a*, 1*b* and 2, and FIG. 13 the detail from FIG. 12 in an oblique view from above with an added slider block guide for actuating the blocking devices of the coupling apparatus.

FIG. 1*a* shows a first exemplary embodiment of an inventive coupling apparatus 10, designed in this case as a telescopic rod, in longitudinal section, whereby the inventive coupling apparatus 10 is designed for arrangement in a valve-actuating apparatus (not shown here), in particular for arrangement in a valve-actuating apparatus able to be actuated by means of a rotatable cam for actuating at least one valve in a reciprocating internal combustion engine with variable valve lift which has at least a first valve-actuating element and particularly a second valve-actuating element.

The inventive coupling apparatus 10 comprises a first coupling element 11 as well as a second coupling element 12, wherein the first coupling element 11 and the second coupling element 12 are in principle telescopically displaceable relative to each other in the axial direction along a first axis A, which in this embodiment coincides with the longitudinal axis of the coupling apparatus 10, up to the respective (limit) stops; i.e. at least within defined limits.

To that end, the first coupling element 11 is at least partially of piston-like configuration and has in particular a piston-like free end, and the second coupling element 12 is at least partially of cylinder-like configuration and has in particular a cylindrical free end. In this case, both the first piston element 11 as well as the cylindrical second piston element 12 exhibit a respective circular or hollow cylindrical cross section.

The coupling apparatus 10 further comprises a blocking device 13 having a sleeve-like blocking element 13B and a radially outward extending pin 13A which serves to actuate the blocking element 13B via a slider block guide. The pin 13A thereby forms a first sliding guide element which is designed to cooperate with a second sliding guide element of a slider block guide which is not shown here and corresponds to pin 13A arranged outside of the coupling apparatus 10.

The blocking device 13 is thereby designed to selectively block or unblock the relative displacement of the two coupling elements 11 and 12 relative to each other along the first axis A. To that end, the blocking element 13B is circumferentially rotatable around the first axis A at least in a defined range, wherein the relative displacement of the two coupling elements 11 and 12 along the first axis A is blocked when the blocking element 13B is in a blocking position as shown in FIG. 1*a*. Correspondingly, the relative displacement of the two coupling elements 11 and 12 along the first axis A is unblocked when the blocking element 13B is in an unblocking position, whereby the blocking element 13B is rotatable about the first axis A between the unblocking position and the blocking position.

To block the axial relative displacement, the blocking element 13B needs to be rotated in a first direction about the first axis A up to a blocking position and to unblock same, it needs to be rotated in a second opposite direction, in particular up to an unblocking position. The blocking device 13 comprises a pressure piece 15 in the form of a prestressed ball which holds the blocking element 13B in the end positions; i.e. in the blocking position and in the unblocking position.

Preferably, the first axis A is arranged in a defined angular range in relation to a lift direction of the actuated valves 101 of the reciprocating machine. Depending on the operating position of the rocker arm parts 102A, 102B and a switch position of the coupling elements 11, 12, the angular range defines an angle between approximately 60° and 120°, preferentially between approximately 75° and 105°, further preferentially an angle of approximately 90°. Alternatively, the angular range defines an angle between approximately 20° and 80°, preferentially between approximately 35° and 65°, further preferentially an angle of approximately 50°. Alternatively, the angular range defines an angle between approximately 100° and 160°, preferentially between approximately 115° and 145°, further preferentially an angle of approximately 130°. In other words, the first axis A runs at an angle in at least one of the above-cited angular ranges to a lift direction of the actuated valves 101.

The blocking device 13, in particular the sleeve-like blocking element 13B, is thereby arranged so as to at least partially overlap both the first coupling element 11 as well as the second coupling element 12, whereby the blocking device 13, in particular blocking element 13B, is fixed in the axial direction on the second coupling element 12 by means of a retaining ring 14 made of spring steel which is guided in a groove on the blocking element 13B.

The blocking device 13, in particular the blocking element 13B, in this exemplary embodiment thereby completely extends around both the first coupling element 11 and the second coupling element 12; i.e. the blocking element 13B in this exemplary embodiment of an inventive coupling apparatus 10 is of circumferentially closed configuration. Preferably, as depicted in FIG. 1*a* and in particular visible in FIG. 1*b*, the blocking element 13B extends around the first coupling element 11 and/or the second coupling element 12 at a respective outer face of the first coupling element 11 and/or second coupling element 12. In other words, the blocking element 13B in the depicted exemplary embodiment stretches all around the respective outer face of the first coupling element 11 and/or second coupling element 12.

As is readily apparent from FIG. 1*b*, which shows an exploded view of the coupling apparatus 10 from FIG. 1*a*, in order to effect the blocking and then unblocking, the first coupling element 11 of the inventive coupling apparatus from FIG. 1*a* comprises a first section 16 extending in the longitudinal direction of the coupling element 11 which has an external longitudinal toothing as well as a second section 18 without toothing which likewise extends in the longitudinal direction of the first coupling element 11 and directly adjoins the first section 16. Moreover provided is a further third section 19 adjoining the second section 18 which likewise extends in the longitudinal direction of the first coupling element 11 and likewise exhibits an external longitudinal toothing.

The blocking device 13, in particular the sleeve-like blocking element 13B, exhibits an internal longitudinal toothing 17 formed over part of its axial length which corresponds to the toothing geometry of the first section 16 and of the third section 19, wherein the internal longitudinal toothing 17 only extends in the axial direction over the length of an area corresponding at most to the width of the second section 18 without toothing so that the blocking element 13B is rotatable about the first axis when the coupling element 11 with the axial external longitudinal toothing is axially displaced relative to the blocking element 13B such that the internal longitudinal toothing 17 of the blocking element 13B is not in engagement with the external longitudinal toothing of the first coupling element 11 but is instead at the level of the second section 18 formed without toothing; i.e. between sections 16 and 19.

An external diameter of the second section 18 of the first coupling element 11 without toothing is thereby smaller than a tip diameter of the external longitudinal toothing of the first section 16 of the first coupling element 11, whereby in particular the external diameter of the second section 18 is smaller than or equal to the root diameter of the external longitudinal toothing of the first section 16.

The external longitudinal toothing of the third section 19 serves to improve the guidance of the first coupling element 11 in the blocking element 13B and/or in the second coupling element 12, whereby the toothing geometry of the external longitudinal toothing of the third section 19 is identical in form to the toothing geometry of the external longitudinal toothing of the first section 18.

The third section 19 in this exemplary embodiment is thereby arranged directly adjacent the second section 18 without toothing and at the free end of the first coupling element 11, whereby the individual teeth of the third section 19 are arranged in alignment with the teeth of the external longitudinal toothing in the first section 16.

The blocking element 13B is thereby in the blocking position when the coupling element 11 with the external longitudinal toothing is axially displaced relative to the blocking element 13B such that the internal longitudinal toothing 17 is not in engagement with the external longitudinal toothing 16 of the coupling element but instead the internal longitudinal toothing 17 of the blocking element 13B is axially situated at the level of the second section 18 without toothing and when the blocking element 13B is rotated in the circumferential direction; i.e. rotated about the first axis A, such that at least one tooth, in particular all the teeth, of the external longitudinal toothing of the first section 16 of the coupling element 11 at least partially align axially with at least one tooth, in particular all the teeth, of the internal longitudinal toothing of the blocking element 13B, particularly in such a way that their end faces lie against each other.

Correspondingly, the blocking element 13B is in the unblocking position when the blocking element 13B is rotated in the circumferential direction such that all the teeth of the external longitudinal toothing of the first section of the coupling element are disposed offset to all the teeth of the internal longitudinal toothing of the blocking element 13B such that the teeth of the external longitudinal toothing of the first coupling element engage with the teeth of the internal longitudinal toothing over at least part of their axial length or can be brought into engagement with one another by an axial relative displacement between the coupling element 11 and the blocking element 13B, whereby the individual tooth flanks of the adjoining teeth of the coupling element 11 and the blocking element 13B do not necessarily need to touch when in engagement, an "intermeshing" is adequately sufficient.

The coupling apparatus 10 depicted in FIGS. 1*a* and 1*b* is thereby connectable in particular to a divided rocker arm 102 of a valve-actuating apparatus having two rocker arm parts able to be rotated about a common rotational axis 103, see FIGS. 2 and 3, whereby the first coupling element 11 is pivotally connectable to a first valve-actuating element in the form of a first rocker arm part 102B and the second coupling element 12 pivotable with a second rocker arm part 102A.

Such a coupling apparatus 10 pursuant to the invention enables simple transmission of a valve-actuating motion introduced into the first rocker arm part 102B, generated in particular via a cam 104, from the first rocker arm part 102B to the second rocker arm part 102A, and from there onto the valve 101, and a valve lift effected or a valve-actuating motion introduced into the first rocker arm part 102B dissipated or dispelled by means of the coupling device 10.

The valve-actuating motion is thereby dissipated or dispelled when the blocking element 13B is in the unblocking position so that the first coupling element 11 can sink unhindered into the cylindrical section of the second coupling element 12 without the valve-actuating motion being transmitted to the second coupling element 12.

In contrast, transmission of the valve-actuating motion occurs when the blocking element 13B is in the blocking position and an axial relative displacement of the two coupling elements 11 and 12 to one another is blocked.

So doing enables a first defined valve lift and in particular a second defined valve lift in the form of zero lift to be selectively set very easily, and in particular mechanically, with the resulting advantages.

FIG. 2 shows a schematic depiction of a first exemplary embodiment of an inventive valve-actuating apparatus 100, wherein the valve-actuating apparatus 100 has a divided rocker arm 102 which comprises a first cam-side rocker arm part 102B as well as a second valve-side rocker arm part 102A. The cam-side rocker arm part 102B and the valve-side rocker arm part 102A of the rocker arm 102 are thereby each rotatably mounted about a common rotational axis 103 and coupled together by means of the inventive coupling apparatus 10 from FIGS. 1*a* and 1*b*, which is only implied here, such that a valve-actuating motion generated by a cam 104 rotatable about a rotational axis 105 can be transmitted to the cam-side rocker arm part 102B via a push rod 106 and from there, depending on the state of the coupling device 10, can be transmitted on either to the valve-side rocker arm part 102A, and thus to a valve 101 to be actuated, or can be dissipated in the coupling apparatus 10, in particular by the telescoping of coupling elements 11 and 12 of the coupling apparatus 10.

For a better understanding of FIG. 2, FIG. 3 shows a cross-sectional detail of the valve-actuating apparatus from FIG. 2 in the area of the inventive coupling apparatus. Particularly recognizable in this depiction is the pivotable connection of the coupling elements 11 and 12 to the rocker arm parts 102A and 102B as only implied by the bolts. Preferably, this pivotable connection is in each case made via a joint 28; 29. In this case, each connection is articulated. A first joint 28 connects preferably the cam-side rocker arm part 102B to the first coupling element 11. A second joint 29 connects the valve-side rocker arm part 102A preferably to the second coupling element 12. As an example, the joints 28, 29 are thereby formed by openings in the coupling elements 11, 12 by means of which same are rotatably mounted about the bolt elements of the rocker arm parts 102A, 102B occupying them, as can be seen from the different hatching patterns in FIG. 3. Other embodiments of the joints 28, 29 are also possible.

FIGS. 4*a* to 4*c* and 5 depict a second exemplary embodiment of an inventive coupling apparatus 20, wherein this coupling apparatus 20 exhibits a differently configured blocking mechanism, in particular a differently configured blocking device 23, as well as corresponding differently configured coupling elements 21 and 22 than the previously described exemplary embodiment of inventive coupling apparatus 10.

The blocking device 23 of the coupling apparatus 20 comprises a plurality of wedge blocks 24 arranged between the radially further inward coupling element 21 and the blocking device 23, in particular between the inner coupling element 21 and the blocking element 23B, whereby all the wedge blocks 24 are axially arranged in an overlap area in which the first coupling element 21 and the second coupling element 22 overlap in the axial direction.

As is readily seen from FIG. 4*b*, all of the wedge blocks 24 are thereby at least partially radially displaceable inwardly and as a result can be brought into engagement with the radially inner coupling element 21 so as to block an axial relative displacement along the first axis A between the first coupling element 21 and the second coupling element 22, in particular a telescoping of the two coupling elements 21 and 22 into each other.

To that end, the wedge blocks 24 are inset into respective recesses 27 of the second coupling element 22, as can be clearly seen from FIG. 4*c*, namely in the area of a circumferential groove 26 in the first coupling element 21.

In addition to axially fixing and guiding the wedge blocks 24, the recesses 27 into which the wedge blocks 24 inset thereby also serve in fixing the wedge blocks 24 in the circumferential direction.

Each of the wedge blocks 24 exhibit a circumferentially extending guide surface configured as a ramp on the radially outer side of the wedge block facing the blocking element 23B and the blocking device 23 comprises a plurality of guide elements, in this case balls 25, which respectively interact with the individual guide surfaces of the wedge blocks 24 interacting with the ramp surfaces of the wedge blocks 24.

The balls 25, which are cradled in the blocking element 23B, thereby interact with the ramp surfaces of the wedge blocks such that a rotating of the blocking element 23B in the circumferential direction from the unblocking position into the blocking position effects a radially inward displacing of the wedge blocks 24 so that the wedge blocks 24 can be brought into engagement with the radially inner coupling element 21, in particular with groove 26, and an axial relative displacement along the first axis A between the two coupling elements 21 and 22 is blocked.

Correspondingly, the rotation of the blocking element 23B from the blocking position into the unblocking position effects the radially outward movement of the wedge blocks 24 again, making possible the axial relative displacement, in particular the telescoping of coupling elements 21 and 23.

Although not perceptible in FIGS. 4*a* to 4*c*, for a more reliable unblocking of the relative displacement, the wedge blocks 24 can be displaced radially inwardly preferably against a restoring force, in particular each against a respective return spring, in order to be brought into engagement with the first coupling element 21 and can correspondingly be moved radially outward again by means of the restoring force.

Alternatively or additionally to the balls 25, other guide elements can also be used, in particular wedged guide elements. Yet the balls 25 used in this exemplary embodiment of an inventive coupling apparatus 20 have the advantage of having an advantageous effect on the friction and in particular have a friction-reducing effect.

The inventive coupling apparatus 20 described on the basis of FIGS. 4*a* to 4*c* is in this case likewise configured, as is above-described coupling apparatus 10, for the pivotable connection of the coupling elements 21 and 22 to rocker arm parts 202A and 202B of a valve-actuating apparatus, wherein the second coupling element 22 is in particular designed for connection to the cam-side rocker arm part 202B and the first coupling element 21 for connection to the valve-side rocker arm part 202A, see FIG. 5.

FIG. 5 shows a detail of a second exemplary embodiment of an inventive valve-actuating apparatus 200 with the coupling apparatus 20 from FIGS. 4*a* to 4*c* in a side view.

The valve-actuating apparatus 200 shown in FIG. 5 thereby differs from the previously described valve-actuating apparatus 100 in that the cam-side rocker arm part 202B is not mechanically coupled to the cam 204 via a push rod but rather directly. The functional principle is otherwise the same as in previously described valve-actuating apparatus 100.

FIGS. 6*a* and 6*b* show a third exemplary embodiment of an inventive coupling apparatus 30, likewise in the blocked state, wherein this coupling apparatus 30 likewise differs from the previously described exemplary embodiments of inventive coupling apparatus 10 and 20 by its blocking mechanism and design of the coupling elements 31 and 32.

This blocking device 33 comprises an expansion sleeve 34 arranged inside the blocking element 33B in the radial direction, whereby the blocking device 33 is designed such that rotation of the blocking element 33B in a first direction about the first axis A, in particular rotation of the blocking element 33 toward the blocking position, enables the compressing of the expansion sleeve 34 in the radial direction and/or in the circumferential direction. The expansion sleeve 34 in this case exhibits a plurality of narrow slots to that end which are evenly distributed circumferentially and extend longitudinally over a portion of its length.

By rotating the blocking element 33 in a second direction about the first axis A, in particular by rotating the blocking element 33B toward the unblocking position, the expansion sleeve can be expanded in the radial direction and/or in the circumferential direction.

The first coupling element 31 and the expansion sleeve 34 are axially displaceable relative to one another, in particular can be telescoped into one another, when the expansion sleeve is not compressed in the radial direction and/or circumferential direction.

A relative displacement in the axial direction between the first coupling element 31 and the expansion sleeve 34 is however blocked when the expansion sleeve 34 is compressed, particularly fully, in the radial direction and/or in the circumferential direction, whereby in this case, the free end of the expansion sleeve 34, in particular its end face, butts against the shoulder 38 of the first coupling element and thus prevents an axial telescoping. The expansion sleeve 34 is axially fixed on the second coupling element 32 and the first coupling element 31 can be at least partially pushed into the expansion sleeve 34 like a telescopic rod.

In this case, in contrast to the previously described exemplary embodiments, for good guidance of the first coupling element 31 within the expansion sleeve 34, the first coupling element 31 is designed with a hollow cylindrical free end or comprises a guide cylinder 39A at its free end respectively. The second coupling element 32 comprises a corresponding piston-like guide pin 39B tailored to the internal diameter of the guide cylinder 39A which is able to be at least partially pushed into the guide cylinder 39A.

So as to ensure that the axial relative displacement between the first coupling element 31 and the expansion sleeve 34 in the blocking position is always blocked when the expansion sleeve 34 is compressed, at least parts of the expansion sleeve 34, particularly in its free end facing the first coupling element 31, exhibit an internal diameter in the compressed state which is smaller than an external diameter of the element 31 axially displaceable in order relative to the expansion sleeve 94, in particular smaller than an external diameter of a shoulder 38 of the first coupling element 31.

To effect or respectively unblock the blocking, the expansion sleeve 34 comprises a section 36 conically tapering toward the coupling element 31 along the first axis and the blocking element 33B rotatable about the first axis comprises a hollow conical section 37 corresponding to the conical section of the expansion sleeve 34 and interacting with the tapered section of the expansion sleeve 34.

In this coupling apparatus 30, the expansion sleeve 34 is coupled to the blocking element 33B by means of threading, whereby a relative movement between the blocking element 33B and the expansion sleeve 34 in the axial direction; i.e. in the direction of first axis A, can be easily effected by a rotational movement of the blocking element 33B, which results in the expansion sleeve being compressed and an axial relative displacement blocked or the expansion sleeve 34 being expanded and an axial relative displacement unblocked.

FIGS. 7*a* to 7*c* show a fourth exemplary embodiment of an inventive coupling apparatus 40 or parts thereof in various views, wherein FIG. 7*a* shows a detail of a third exemplary embodiment of an inventive valve-actuating device 300 in a longitudinal section through a fourth exemplary embodiment of an inventive coupling apparatus 40 in the area of said coupling apparatus 40. FIG. 7*b* shows individual parts of the coupling apparatus from FIG. 7*a* in an exploded view and FIG. 7*c* a detail of the valve-actuating apparatus from FIG. 7*a* in side view.

The blocking mechanism of this coupling apparatus 40 functions in principle like the blocking mechanism of coupling apparatus 10 from FIGS. 1*a*, 1*b* and 2. The first coupling element 41 and the blocking element 43B each have corresponding sections 46, 47, 48 with corresponding toothing. Section 46 thereby corresponds to section 16 from FIG. 1*b* and exhibits a correspondingly configured external longitudinal toothing. Section 47 corresponds to section 17 from FIG. 1*b* and is formed without toothing. Section 48 corresponds to section 18 from FIG. 1*b* and exhibits a correspondingly configured internal longitudinal toothing.

One difference to the coupling apparatus from FIGS. 1*a*, 1*b* and 2, however, is that both the coupling elements 41 and 42 of this coupling apparatus 40 are securely, i.e. rigidly, fixed to the associated rocker arm parts 302B and 302A and are not pivotable as in the previously described exemplary embodiments.

Unlike with coupling apparatus 10, nor is the blocking element 43B fixed to the second coupling element 42 by means of a retaining ring but can only be axially braced against it by a spring element 49 when the blocking element 43B is in the unblocking position.

To that end, the blocking element 43B is of cylindrical configuration. For improved guidance through the second coupling element 42, the cylinder base of blocking element 43B is curved inward and the free end of the second coupling element 42 is of corresponding convex configuration.

In the blocking position, however, the blocking element 43B follows the movement of the coupling element 41 fixedly connected to the cam-side rocker arm part 302B and does not necessarily butt against the second coupling element 42.

This embodiment of the coupling apparatus 40 has the advantage of enabling the setting of valve actuation play which a lash adjusting apparatus can realize, namely by selecting a spring element of a different length, a different spring constant and/or by adjusting the arrangement of the second coupling element 42, in particular by changing the depth of engagement of the second coupling element 42 screwed into the associated rocker arm part 302A to that end by means of a threading 44. The coupling element 42 able to be varied or changed in its position in the rocker arm part 302A by means of threading 44 thus represents an example of a lash adjusting device. Instead of or additionally thereto, the lash adjusting apparatus can also be implemented with one of the variants cited above.

FIG. 8 shows a fourth exemplary embodiment of an inventive valve-actuating apparatus 400 with a fifth exemplary embodiment of an inventive coupling apparatus 50 in a schematic depiction, whereby in contrast to the previously described valve-actuating apparatus 100, 200 and 300, this valve-actuating apparatus 400 has a rigid rocker arm 402 and the inventive coupling apparatus 50 is arranged between the push rod 406 and the rocker arm 402. One of the coupling elements of the coupling apparatus 50 is thereby mechanically coupled, in particular connected, to the push rod 406 and the other coupling element to the rocker arm 402. Accordingly, coupling apparatus 50 differs from the previously described coupling apparatus 10, 20, 30 or 40 in the configuration of its connection. With respect to its functioning, coupling apparatus 50 is thereby designed as per one of the previously described coupling apparatus 10, 20, 30 or 40.

FIG. 9 shows a fifth exemplary embodiment 500 of an inventive valve-actuating apparatus with a sixth exemplary embodiment of an inventive coupling apparatus 60 in a schematic depiction, whereby in contrast to the previously described valve-actuating apparatus 100, 200, 300 and 400, this valve-actuating apparatus 500 has a rigid rocker arm 402 and the inventive coupling apparatus 60 is arranged between the rocker arm 502 and a valve 501 to be actuated. One of the coupling elements of the coupling apparatus 60 is thereby mechanically coupled, in particular connected, to the valve lifter 502 and the other coupling element to the valve 501. Accordingly, coupling apparatus 60 differs from the previously described coupling apparatus 10, 20, 30, 40 and 50 in the configuration of its connection. With respect to its functioning, coupling apparatus 60 is thereby designed as per one of the previously described coupling apparatus 10, 20, 30 or 40.

FIG. 10 shows a sixth exemplary embodiment of an inventive valve-actuating apparatus 600 with a seventh exemplary embodiment of an inventive coupling apparatus 70 in a schematic depiction, whereby in contrast to the previously described valve-actuating apparatus 100, 200, 300, 400 and 500, this valve-actuating apparatus 600 has a two-part push rod 606 and the inventive coupling apparatus 70 is arranged between a first push rod part 606A and a second push rod part 606B. One of the coupling elements of the coupling apparatus 70 is thereby mechanically coupled, in particular connected, to the first push rod part 606A and the other coupling element to the second push rod part 606B. Accordingly, coupling apparatus 70 differs from the previously described coupling apparatus 10, 20, 30, 40, 50 and 60 in the configuration of its connection. With respect to its functioning, coupling apparatus 70 is thereby designed as per one of the previously described coupling apparatus 10, 20, 30 or 40.

FIG. 11 shows a seventh exemplary embodiment of an inventive valve-actuating apparatus 700 with an eighth exemplary embodiment of an inventive coupling apparatus 80 in a schematic depiction, whereby in contrast to the previously described valve-actuating apparatus 100, 200, 300, 400, 500 and 600, this valve-actuating apparatus 700 has a rigid rocker arm 702 and a valve bridge 707 mechanically coupled to two valves 701 and the inventive coupling apparatus 80 is arranged between the rocker arm 702 and the valve bridge 707. One of the coupling elements of the coupling apparatus 80 is thereby mechanically coupled, in particular connected, to the rocker arm 702 and the other coupling element to the valve bridge 707. Accordingly, coupling apparatus 80 differs from the previously described coupling apparatus 10, 20, 30, 40, 50, 60 and 70 in the configuration of its connection. With respect to its functioning, coupling apparatus 80 is thereby designed as per one of the previously described coupling apparatus 10, 20, 30 or 40.

FIG. 12 shows in top view a detail of a reciprocating internal combustion engine according to the invention having two inventive valve-actuating apparatus, each with an inventive coupling apparatus 10, 10' designed as per FIGS. 1*a*, 1*b* and 2, wherein coupling apparatus 10 is depicted in the unblocked state and coupling apparatus 10' in the blocked state.

The difference relative to the position of the blocking element 13B in the unblocking position, in the left half of the image, and in the blocking position in the right half of the image, is clearly visible in this depiction.

Figure 13:
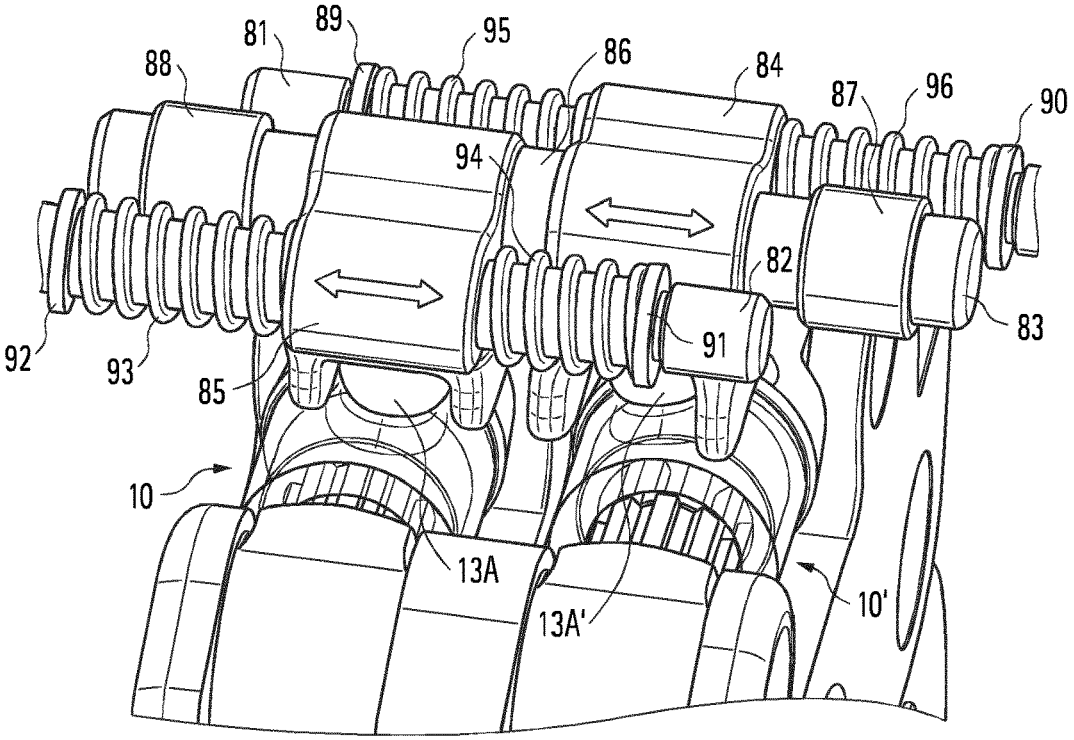

FIG. 13 shows the detail from FIG. 12 in an oblique view from above with an added slider block guide for actuating the blocking devices 13 and 13' of the coupling apparatus 10, 10'.

A rotational movement of the blocking device 13, 13', in particular blocking element 13B, 13B', about the first axis can be effected by means of the slider block guide, in particular from the unblocking position (see left image half) into the blocking position (see right image half) and/or vice versa, whereby one respective first sliding guide element 13A, 13A' is preferably arranged on blocking element 13, 13' which is designed to cooperate with a second sliding guide element 84, 85 of the slider block guide corresponding in design to the first sliding guide element 13A, 13A' and is in particular axially displaceable and supported on the housing side. In each case, the blocking element 13/13' in this exemplary embodiment is circumferentially rotatable about the first axis over an angular range of approximately 30 degrees.

In this case, the first sliding guide element is a radially outward extending link pin 13A, 13A', in particular a radially outward extending pin 13A, 13A' arranged on the annular or sleeve-like section 13B, 13B' of the blocking device 13, 13', particularly the blocking element 13B, 13B'.

The second sliding guide element 84, 85 mounted on the housing side is a pawl 84, 85 able to be axially displaced perpendicular to the first axis, in particular tangentially to the first axis, by means of an actuating rod 81, 82 which is in particular mounted in axially slidable manner on a guide rod 83 fixed to the housing.

For particularly simple actuation of the slider block guide, the second sliding guide element 84, 85 is preferably arranged axially displaceably on the actuating rod 81, 82 between an end stop 86 and stop elements 87, 88 by means of a slide bearing and in each case clamped between two annular disks 91, 92/89, 90 and/or shoulders fixedly connected to the actuating rod 81, 82 by means of two spring elements 93, 94/95, 96, wherein the spring force and the length of the spring elements 93, 94/95, 96 is selected such that a lateral displacement of the actuating rod 81, 82 as a result of a switching operation only leads to an axial displacement of the actuating rod 81, 82, and thus to an actuation of the blocking element 13B, 13B', when the coupling device 10, 10' is virtually load-free or free of load along first axis A; i.e. almost or completely free of axial force in the direction of the first axis A.

Preferably, the slider block guide is thereby configured such that the actuation of the blocking element 13, 13'; i.e. its rotation, is triggered after a switching operation when the respective valve-actuating element rolling on the cam rolls on the base circle of the cam effecting the valve actuation. If, on the other hand, the valve-actuating element rolls on the cam outside of the base circle, thereby subjecting the coupling apparatus 10, 10' to an axial force, the second sliding guide element 84, 85 is still kept in its "old" position due to the friction acting within the coupling apparatus 10, 10'. Not until the transition to the base circle, when a virtually load-free state is reached, does the second sliding guide element 84, 85 become unrestricted and able to be shifted into the desired position by the preloaded spring elements 93, 94/95, 96 and thus a rotation of the blocking element 13B, 13B' effected.

The actuation of the actuating rod of the slider block guide, in particular its axial displacement, can ensue hydraulically, electromagnetically, pneumatically and/or electromechanically, the latter e.g. by means of a linear drive, a ball screw drive rack, a spindle or the like.

This enables the concerted, simultaneous switching of valve-actuating apparatus 100 and 100' for all the cylinders of a reciprocating internal combustion engine; i.e. the concerted displacement of the individual actuating rods 81, 82, without having to actuate the respective blocking element 136, 136' for all cylinders simultaneously and regardless of cycle.

Instead, the respective blocking element 13A, 13A' associated with a cylinder is only actuated, in particular only triggered, after a switching operation when the spring preload force applied by the switching operation and acting on the pawl 84, 85 is greater than that due to the friction acting in the coupling apparatus 10, 10' from the axial forces applied to the coupling apparatus 10, 10'. The appropriate configuration of the slider block guide can thus achieve the blocking element 13B, 13B' only being actuated, in particular rotated, in the virtually load-free or load-free state. The wear on the valve-actuating apparatus, in particular coupling apparatus 10, 10', can thereby be reduced considerably.

Furthermore, the switching operation can be simplified. This is particularly advantageous in the case of reciprocating internal combustion engines having more than four, in particular more than eight, cylinders.

LIST OF REFERENCE NUMERALS

10, 10', 20, 30, inventive coupling apparatus
40, 50, 60, 70, 80
11, 11', 21, 31, 41 first coupling element
12, 12', 22, 32, 42 second coupling element
13, 13', 23, 33, 43 blocking device
13A, 13A', 23A, 33A, 43A sliding guide element (pin)
13B, 13B', 23B, 33B, 43B blocking element
14 retaining ring
15 pressure piece
16, 16', 46 first section with external longitudinal toothing
17, 47 internal longitudinal toothing of blocking element
18, 48 second toothless section
19 third section with external longitudinal toothing
24 wedge block
25 rolling body
26 groove
27 recess
28, 29 joint
34 expansion sleeve
35 threading
36 conical tapered section of expansion sleeve
37 hollow conical section of blocking element
38 shoulder
39A guide cylinder
39B guide pin
44 threading
49 spring element
81 actuating rod
82 actuating rod
83 guide rod
84 sliding guide element (pawl)
85 sliding guide element (pawl)
86 end stop
87 stop element
88 stop element
89 annular disk
90 annular disk
91 annular disk
92 annular disk
93 spring element
94 spring element
95 spring element
96 spring element
100, 100', 200, 300, inventive valve-actuating apparatus
400, 500, 600, 700
101, 501, 701 valve
102, 402, 502, 702 rocker arm
102A, 202A, 302A valve-side rocker arm part
102B, 202B, 302B cam-side rocker arm part
103 rotational axis of rocker arm part
104, 204 cam
105 rotational axis of cam
106, 406, 606 push rod
606A first push rod part
606B second push rod part
707 valve bridge
A first axis

The invention claimed is:

1. A coupling apparatus for a valve-actuating apparatus for actuating at least one valve of a reciprocating machine with variable valve lift, comprising:

a first coupling element;

a second coupling element; and a blocking device having a blocking element, wherein one of the first or second coupling elements exhibits a first section having external longitudinal toothing and a second section formed without toothing, wherein the first coupling element and the second coupling element are displaceable relative to one another along a first axis, and/or the first coupling element and the blocking element are displaceable relative to one another along the first axis, wherein the blocking device can block a relative displacement of the first and second coupling elements to one another and/or block a relative displacement between the first coupling element and the blocking element at least in a first direction along the first axis, wherein the blocking element is circumferentially rotatable about the first axis over at least one defined angular range, wherein the relative displacement of the first and second coupling elements to one another along the first axis and/or the relative displacement between the first coupling element and the blocking element is blocked at least in the first direction along the first axis when the blocking element is in a blocking position.

2. The coupling apparatus according to claim 1, wherein the relative displacement of the first and second coupling elements to one another and/or the relative displacement between the first coupling element and the blocking element along the first axis is unblocked at least in the first direction when the blocking element is in an unblocking position.

3. The coupling apparatus according to claim 1, wherein the coupling apparatus is designed to be arranged in the valve-actuating apparatus, wherein the valve-actuating apparatus is designed to actuate the at least one valve of the reciprocating machine with variable valve lift and the valve-actuating apparatus comprises at least a first valve-actuating element and, wherein the coupling apparatus is designed such that the first coupling element can be mechanically coupled to the first valve-actuating element and the second coupling element can be mechanically coupled a valve to be actuated.

4. The coupling apparatus according to claim 1, wherein the blocking element exhibits an annular or sleeve-like section, wherein the annular or sleeve-like section of the blocking element at least partially overlaps the first coupling element and/or the second coupling element in an axial direction.

5. The coupling apparatus according to claim 1, wherein the coupling apparatus comprises a lash adjusting apparatus for setting kinematic play in the coupling apparatus.

6. The coupling apparatus (according to claim 1, wherein the first coupling element and the second coupling element can be at least partially telescoped into one another along the first axis when the blocking element is in the unblocking position.

7. The coupling apparatus according to claim 1, wherein at least one of the first and second coupling elements and the blocking device can be at least partially telescoped into one another along the first axis when the blocking element is in the unblocking position.

8. The coupling apparatus according to claim 1, wherein the blocking element exhibits a section extending in an axial direction which has an internal longitudinal toothing corresponding in form to the external longitudinal toothing of the first section of the respective coupling element.

9. The coupling apparatus according to claim 8, wherein the blocking element is in the blocking position when the coupling element with the external longitudinal toothing is axially displaced in the axial direction relative to the blocking element such that the internal longitudinal toothing is not engaged with the external longitudinal toothing of the coupling element but the internal longitudinal toothing of the blocking element is instead at a level of the second section formed without toothing, and when the blocking element is rotated in a circumferential direction such that at least one tooth, of the outer longitudinal toothing of the first section of the respective coupling element at least partially align axially with at least one tooth of the internal longitudinal toothing of the blocking element.

10. The coupling apparatus according to claim 8, wherein the blocking element is in the unblocking position when the blocking element is circumferentially rotated such that all the teeth of the external longitudinal toothing of the first section of the coupling element are offset to all the teeth of the internal longitudinal toothing of the blocking element so that the teeth of the outer longitudinal toothing of the coupling element are engaged with the teeth of the internal longitudinal toothing at least over part of their axial length or can be brought into engagement with each other by an axial relative displacement between the coupling element with the external longitudinal toothing and the blocking element.

11. The coupling apparatus according to claim 8, wherein the blocking element can be rotated about the first axis when the coupling element with the external longitudinal toothing is axially displaced in the axial direction relative to the blocking element such that the internal longitudinal toothing is not engaged with the external longitudinal toothing of the coupling element but is instead at a level of the second section formed without teeth.

12. The coupling apparatus according to claim 6, wherein the blocking device comprises a first wedge block radially arranged between an inner coupling element and the blocking device, and wherein a second wedge block is axially arranged in an overlap area in which the first coupling element and the second coupling element overlap in an axial direction.

13. The coupling apparatus according to claim 12, wherein at least one of the first and second wedge blocks can be inwardly displaced in a radial direction and brought into engagement with the radially inner coupling element such that an axial relative displacement between the first coupling element and the second coupling element along the first axis is blocked.

14. The coupling apparatus according to claim 13, wherein at least one of the first and second wedge blocks have a circumferentially extending guide surface formed as a ramp and the blocking device comprises at least one guide element interacting with the guide surface so that the at least one of the first and second wedge blocks is brought into engagement with the radially inner coupling element and an axial relative displacement between the first coupling element and the second coupling element along the first axis is blocked.

15. The coupling apparatus according to claim 6, wherein the blocking device comprises an expansion sleeve radially arranged within the blocking element, wherein the blocking device is designed such that the expansion sleeve can be compressed in a radial direction and/or a circumferential direction by rotating the blocking element in a first direction about the first axis.

16. The coupling apparatus according to claim 15, wherein the expansion sleeve can be expanded in the radial direction and/or the circumferential direction by rotating the blocking element in a second direction about the first axis.

17. The coupling apparatus according to claim 15, wherein at least one coupling element and the expansion sleeve are axially displaceable relative to one another along the first axis when the expansion sleeve is not compressed in the radial direction and/or the circumferential direction.

18. The coupling apparatus according to claim 15, wherein when the blocking element is in the blocking position, at least part of the expansion sleeve exhibits a smaller internal diameter than an external diameter of the coupling element axially displaceable relative to the expansion sleeve.

19. The coupling apparatus according to claim 15, wherein the expansion sleeve exhibits a conically tapering section and the blocking element rotatable about the first axis comprises a hollow conical section corresponding to the conical section of the expansion sleeve and with which the tapering section of the expansion sleeve interacts, wherein the expansion sleeve is coupled to the blocking element.

20. A valve-actuating apparatus, wherein the valve-actuating apparatus is designed to actuate at least one valve of a reciprocating machine with variable valve lift and comprises a coupling apparatus, wherein the coupling apparatus is designed according to claim 3.

21. The valve-actuating apparatus according to claim 20, wherein the valve-actuating apparatus comprises at least one rocker arm having at least one first rocker arm part as the first valve-actuating element and a second rocker arm part as a second valve-actuating element, wherein the first rocker arm part and the second rocker arm part are both rotatably mounted about a common rotational axis, wherein one coupling element is mechanically coupled to the first rocker arm part and the other coupling element is mechanically coupled to the second rocker arm part.

22. The valve-actuating apparatus according to claim 20, wherein the valve-actuating apparatus comprises at least one rocker arm as the first valve-actuating element and a push rod as a second valve-actuating element, wherein one coupling element is mechanically coupled to the push rod and the other coupling element is mechanically coupled to the rocker arm.

23. The valve-actuating apparatus according to claim 20, wherein the valve-actuating apparatus comprises at least one rocker arm as the first valve-actuating element, wherein one coupling element is mechanically coupled to the rocker arm and the other coupling element is mechanically coupled to a valve to be actuated.

24. The valve-actuating apparatus according to claim 20, wherein the valve-actuating apparatus comprises at least one divided push rod having a first push rod part as the first valve-actuating element and a second push rod part as a second valve-actuating element, wherein one coupling element is mechanically coupled to the first push rod part and the other coupling element is mechanically coupled to the second push rod part.

25. The valve-actuating apparatus according to claim 20, wherein the valve-actuating apparatus comprises at least one rocker arm as the first valve-actuating element and a valve bridge as a second valve-actuating element, wherein one coupling element is mechanically coupled to the rocker arm and the other coupling element is mechanically coupled to the valve bridge.

26. The valve-actuating apparatus according to claim 20, wherein the valve-actuating apparatus comprises a slider block guide for actuating the blocking device of the coupling apparatus, wherein the slider block guide can effect a rotational movement of the blocking device, wherein a first sliding guide element designed to cooperate with a second sliding guide element of the slider block guide corresponding in design to the first sliding guide element is arranged on the blocking element.

27. A reciprocating machine comprising a valve-actuating apparatus, wherein the valve-actuating apparatus is designed according to claim 20.

* * * * *